US009631428B2

(12) United States Patent
Niemela

(10) Patent No.: US 9,631,428 B2
(45) Date of Patent: Apr. 25, 2017

(54) TREE-MOUNTED SUPPORTS

(71) Applicant: Cal G. Niemela, Chassell, MI (US)

(72) Inventor: Cal G. Niemela, Chassell, MI (US)

( * ) Notice: Subject to any disclaimer, the term of this patent is extended or adjusted under 35 U.S.C. 154(b) by 0 days.

(21) Appl. No.: 14/875,162

(22) Filed: Oct. 5, 2015

(65) Prior Publication Data

US 2016/0024843 A1 Jan. 28, 2016

Related U.S. Application Data

(63) Continuation-in-part of application No. 13/949,869, filed on Jul. 24, 2013, now Pat. No. 9,151,112.
(Continued)

(51) Int. Cl.
*E06C 1/10* (2006.01)
*E06C 7/18* (2006.01)
*E06C 1/38* (2006.01)

(52) U.S. Cl.
CPC ..... *E06C 1/10* (2013.01); *E06C 1/381* (2013.01); *E06C 7/188* (2013.01)

(58) Field of Classification Search
CPC .. A01M 31/02; E06C 1/02; E06C 1/00; E06C 1/04; E06C 1/08; E06C 1/10; E06C 1/12;
(Continued)

(56) References Cited

U.S. PATENT DOCUMENTS 159,126 A * 1/1875 Van Zandt ..... E06C 1/32 182/24
907,483 A 12/1908 Ette
(Continued)

FOREIGN PATENT DOCUMENTS

FR 2886973 A1 * 12/2006 ..... B60R 3/02
JP WO 2007080625 A1 * 7/2007 ..... E06C 1/36

OTHER PUBLICATIONS

Exhibit A includes photos of various "climbing sticks," at least three of which ("Ameristep", "Muddy Outdoors," and "Gorilla") are believed to have been on sale more than one year prior to the filed of this application.

(Continued)

*Primary Examiner* — Katherine Mitchell
*Assistant Examiner* — Shiref Mekhaeil
(74) *Attorney, Agent, or Firm* — Gardner, Linn, Burkhart & Flory, LLP

(57) ABSTRACT

Climbing devices and tree supports are provided for aiding a climber in scaling a tree, pole, or other generally vertical surface, and for supporting the climber at an elevated position along a tree or pole, such as in a standing or sitting posture. The climbing and tree supports include a body that supports one or more steps or support surfaces or handholds, a strap, cable, or other flexible securing member that is wrapped around the tree, and a retractor for stowing the flexible securing member so that it is extendable and retractable from the support. The climbing and tree supports are thus substantially self-contained so as not to require separate components for installation or use. Standoffs may be provided for stabilizing the support in a location spaced from the tree. Optionally, the steps or footrests, standoffs, and body are collapsible to compact configurations for stowage or transport.

18 Claims, 32 Drawing Sheets

Related U.S. Application Data

(60) Provisional application No. 61/675,635, filed on Jul. 25, 2012.

(58) Field of Classification Search
CPC ... E06C 1/34; E06C 1/38; E06C 1/381; E06C 7/00; E06C 7/50; E06C 7/505
See application file for complete search history.

(56) References Cited

U.S. PATENT DOCUMENTS 1,270,158 A 6/1918 Hill
1,719,997 A * 7/1929 Pirsch ..... E06C 1/36 182/156
1,748,673 A 2/1930 Hurst
1,953,298 A * 4/1934 Goodwin ..... B61D 23/02 105/1.3
2,052,439 A * 8/1936 Bailey ..... E06C 1/12 182/189
2,148,099 A * 2/1939 Russell ..... B66B 5/027 182/156
2,680,593 A * 6/1954 McIntyre ..... A62B 1/10 182/231
3,019,851 A * 2/1962 Doss ..... E06C 1/381 182/111
3,148,857 A * 9/1964 Hutchison ..... E04G 5/06 108/135
3,233,591 A * 2/1966 Rogers ..... A01K 27/004 119/796
3,493,079 A * 2/1970 Dudschus ..... B66F 11/04 182/141
3,596,736 A * 8/1971 Crawford ..... B66F 9/205 182/148
3,891,273 A * 6/1975 Takada ..... B60R 22/357 24/DIG. 51
4,061,306 A * 12/1977 Taylor ..... A47G 33/1213 248/523
4,132,288 A * 1/1979 Bingham ..... E06C 1/387 182/100
4,413,706 A * 11/1983 Michael ..... A63B 27/00 182/91
4,415,061 A 11/1983 Meyer
4,432,436 A * 2/1984 Suiter ..... B63B 27/14 114/343
4,542,805 A * 9/1985 Hamlin ..... E06C 9/04 182/100
4,669,575 A * 6/1987 Skyba ..... A63B 27/00 182/92
4,719,990 A * 1/1988 Markovic ..... E06C 7/44 182/163
4,867,272 A 9/1989 Troubridge
4,877,110 A * 10/1989 Wolner ..... A62B 35/0093 182/18
5,040,635 A * 8/1991 Strickland ..... E06C 1/381 182/100
5,242,030 A * 9/1993 Lobozzo ..... A01M 31/006 182/116
5,253,732 A * 10/1993 Daniels ..... A01M 31/02 182/100
5,267,632 A * 12/1993 Mintz ..... A01M 31/02 182/116
5,279,388 A 1/1994 Laughlin et al.
5,655,623 A * 8/1997 Skyba ..... E06C 1/381 182/100
5,743,353 A 4/1998 Browning et al.
5,779,001 A 7/1998 Skyba
6,170,609 B1 * 1/2001 Dech ..... A01M 31/02 182/100
6,311,918 B1 * 11/2001 Specht ..... B60R 22/44 242/379
6,334,508 B1 * 1/2002 Shields ..... A01M 31/02 182/116
6,340,071 B1 * 1/2002 Diekemper ..... E06C 1/34 182/100
6,439,343 B1 8/2002 Jorges et al.
6,484,981 B1 * 11/2002 Perrault ..... A63B 27/00 182/92
6,547,035 B1 * 4/2003 D'Acquisto ..... A01M 31/00 182/100
6,588,546 B1 * 7/2003 Forrest ..... A01M 31/02 182/135
6,595,325 B2 * 7/2003 Ulrich ..... A01M 31/02 182/136
6,668,975 B2 * 12/2003 Skipper ..... A01M 31/02 182/100
6,782,840 B1 * 8/2004 Garelick ..... B63B 27/14 114/362
7,246,683 B2 * 7/2007 Pringnitz ..... A01M 31/02 182/187
7,258,045 B2 8/2007 Smith
7,584,940 B2 * 9/2009 Gee ..... A01M 31/02 182/135
7,882,931 B2 * 2/2011 D'Acquisto ..... A01M 31/02 182/187
8,556,035 B1 * 10/2013 Kendall ..... E06C 1/381 182/156
8,684,390 B1 * 4/2014 Barrette ..... B60D 1/185 242/370
8,695,762 B1 * 4/2014 Carter ..... A01M 31/02 182/115
2003/0029671 A1 * 2/2003 Voorhies ..... A63B 27/02 182/20
2004/0031898 A1 * 2/2004 Mijatovic ..... G09F 7/18 248/330.1
2004/0035637 A1 * 2/2004 Skipper ..... A01M 31/02 182/92
2005/0217937 A1 * 10/2005 Rohlf ..... A62B 1/16 182/232
2007/0256892 A1 * 11/2007 Breedlove, Sr. ..... A01M 31/02 182/116
2008/0156588 A1 * 7/2008 Butcher ..... E06C 1/34 182/200
2008/0196972 A1 * 8/2008 Bell ..... E06C 1/34 182/92
2009/0045012 A1 2/2009 Mencl
2009/0178887 A1 * 7/2009 Reeves ..... A62B 1/10 182/239
2013/0161127 A1 * 6/2013 Allred, III ..... E06C 1/02 182/108
2013/0299275 A1 * 11/2013 Westermann ..... A62B 35/0093 182/3

OTHER PUBLICATIONS

Commonly-owned U.S. Appl. No. 13/275,408, filed Oct. 18, 2011.

* cited by examiner

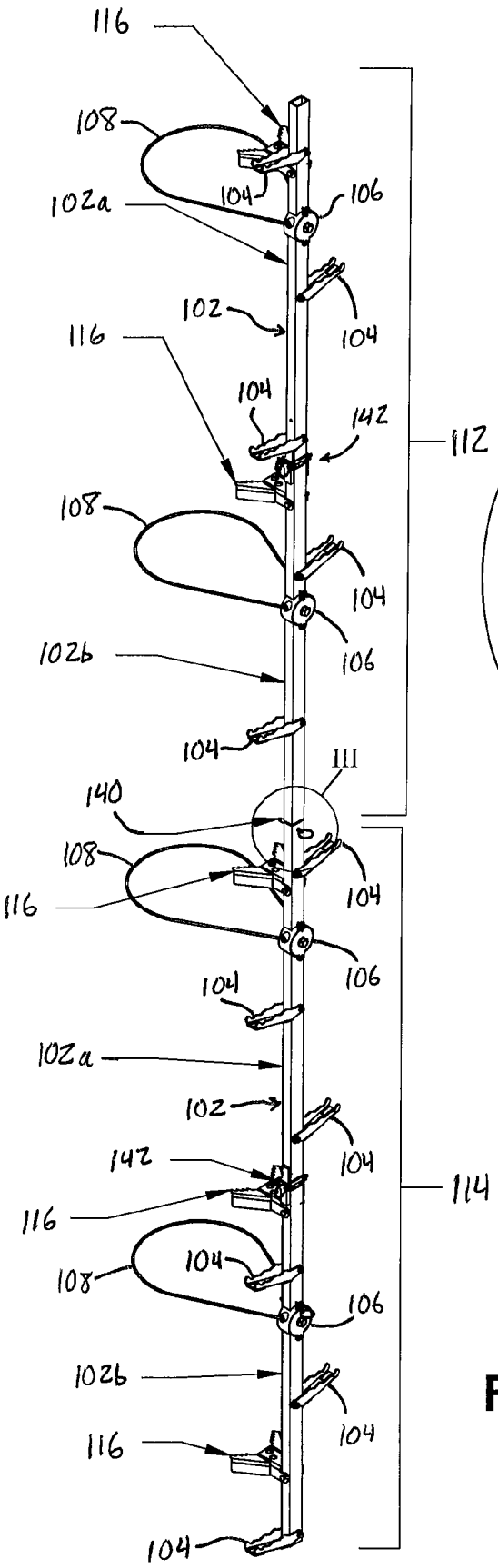
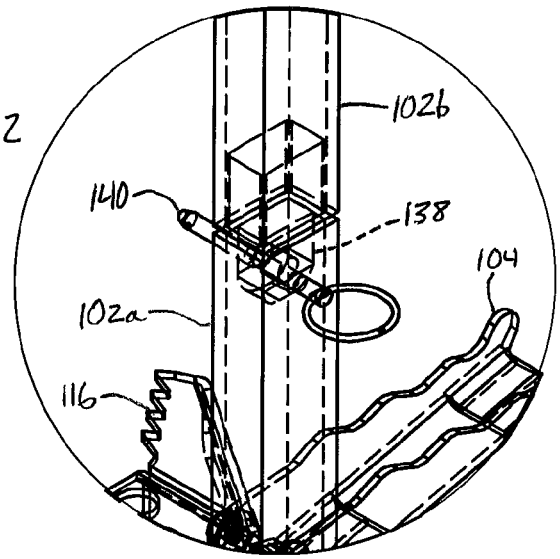
FIG. 3
FIG. 2

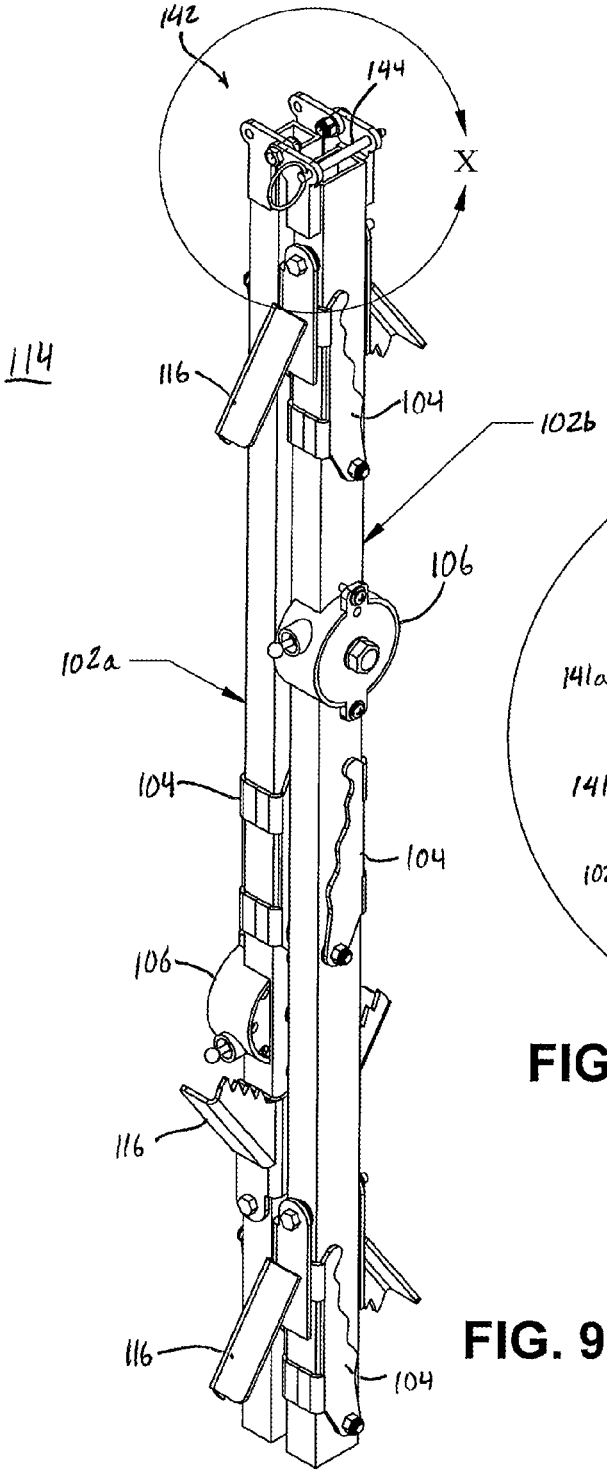
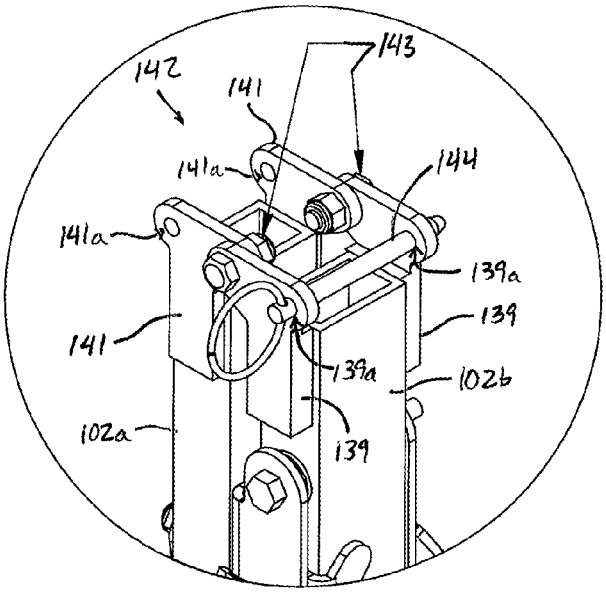
FIG. 10
FIG. 9

TREE-MOUNTED SUPPORTS

CROSS REFERENCE TO RELATED APPLICATIONS

The present application is a continuation-in-part of U.S. patent application Ser. No. 13/949,869, filed Jul. 24, 2013, now U.S. Pat. No. 9,151,112, issued Oct. 6, 2015, which claims the priority benefit of U.S. provisional application, Ser. No. 61/675,635, filed Jul. 25, 2012, both of which are hereby incorporated herein by reference in their entireties.

FIELD OF THE INVENTION

The present invention is directed to portable climbing and support apparatuses, and more particularly, to ladder-like supports and platforms or stands for attachment to trees, poles, and the like.

BACKGROUND OF THE INVENTION

The ability to safely and efficiently climb or scale trees, poles such as telephone or powerline poles, and similar structures or surfaces, is useful for reaching elevated hunting blinds, servicing utility wires, and the like. Although ladder-like "climbing sticks" are sometimes used for climbing, these are typically tied or strapped to trees or poles using loose ropes or straps, and are generally bulky and time consuming to install and remove. Likewise, conventional portable tree stands and the like can be challenging to transport, raise up a tree or pole, and secure quickly and tightly for use.

SUMMARY OF THE INVENTION

The present invention provides person supports and climbing apparatuses ("supports") that can be readily configured between a "use" configuration and a more compact "transport" configuration, and that can be readily installed and removed by one person. The upports can be configured in a stowage or transport configuration that is substantially more compact than the use configuration, so that several supports can be carried at once by a single user. One or more retractors that are included on the support provide convenient stowage of securing cables, straps, or the like when the assemblies are not in use, thus avoiding tangles or knots that are more likely to occur if the cables or straps are not stored in an organized fashion. Once the support is secured to a tree or the like, steps or platforms are provided which may be used as hand-holds and/or foot-holds as a climber scales or rests along the support.

In one form of the present invention, a support is provided for supporting a user along a tree or pole, and includes an elongate body, a foot support, a flexible elongate securing member, and a retractor. The elongate body defines an interior region and the foot support extends outwardly from the elongate body. The flexible elongate securing member is coupled to the elongate body at the interior region. At least a portion of the securing member is selectively extendable outwardly from the interior region of the elongate body and is configured to wrap around a tree or pole to thereby attach the support. At least a portion of the securing member is retractable at the elongate body for compact storage or transport when the securing member is not in use. A retractor is disposed at the elongate body, and is operable to selectively retract at least a portion of the securing member for storage inside the interior region of the elongate body, and operable to permit the securing member to be extended outwardly from the interior region of the elongate body, for use in securing the support to the tree or pole.

In one aspect, the retractor includes a spool for selectively winding and unwinding the securing member between retracted and extended configurations. Optionally, the retractor includes a lock member for selectively securing the spool against rotation. The retractor may further include one or more of (i) a tool-engaging head to facilitate manual rotation of the spool with a tool, (ii) a spring configured to bias the spool to rotate for winding the securing member onto the spool, and (iii) a ratcheting mechanism for securing the spool against unintended unwinding of the securing member.

In another aspect, the retractor includes a spool for selectively winding and unwinding the securing member between retracted and extended configurations. The spool includes a spindle positioned at least partly in the interior region of the elongate body. Optionally, the retractor includes a lock member for selectively securing the spool against rotation.

In a further aspect, the retractor includes a handle coupled to the spindle, and the spool has a plurality of teeth arranged around its outer perimeter. The handle is configured to selectively engage the teeth to thereby permit rotation of the spool and tightening of the securing member.

In another aspect, the retractor includes a tensioning pulley about which the securing member is wound. The tensioning pulley is translatable relative to the elongate body to thereby adjust tension or slack in the securing member. Optionally, the retractor further includes a substantially non-translatable pulley coupled to the elongate body and spaced from the tensioning pulley, and wherein the securing member is wound at least partially around the non-translatable pulley.

In still another aspect, the securing member includes a first end portion fixedly secured to the elongate body, a second end portion that is extendable and retractable relative to the elongate body, and a middle portion between the first and second end portions. The middle portion of the securing member extends from the first end portion, wraps around the tensioning pulley, wraps around the non-translatable pulley, and extends outwardly from the elongate body where the securing member is terminated at the second end portion.

In a further aspect, the retractor and at least a portion of the securing member are positioned inside of the elongate body, and the elongate body includes a generally tubular structure having an internal elongate divider wall to which the first end portion of the securing member and the non-translatable pulley are coupled. Optionally, the generally tubular structure of the elongate body further includes at least one outer wall spaced outwardly from the divider wall and defines an elongate channel for translatably supporting the tensioning pulley.

In a still further aspect, the tensioning pulley includes a shaft having a grasping end portion that projects outwardly from the elongate body, and a lock end portion opposite the grasping end portion. The shaft is axially movable between an unlocking position and a locking position, and the divider wall of the elongate body includes a plurality of bores in longitudinally-spaced arrangement for selectively receiving the lock end portion of the tensioning pulley in the locking position to thereby selectively secure the tensioning pulley against translation relative to the elongate body.

In yet another aspect, the step member is pivotably coupled to the elongate body, and is pivotable between an outwardly-extending position for use as a hand-hold or foot support, and a retracted position for compact stowage along the elongate body.

In another aspect, the climbing support further includes a standoff member coupled to the elongate body and configured to engage the tree or pole and to maintain a space between the elongate body and the tree or pole when the securing member is wrapped around the tree or pole. Optionally, the standoff member is repositionable between a substantially horizontal orientation for engaging the tree or pole, and a substantially vertical orientation along the elongate body for compact stowage and transport.

In still another aspect, the elongate body includes an attachment element for selectively receiving and retaining a distal end portion of the securing member when the securing member is extended from the elongate body and wrapped around the tree or pole.

In another form of the present invention, a support for supporting a user along a tree or pole includes an elongate body, a pair of deployable supports, a repositionable standoff member, and a flexible elongate securing member. The elongate body has upper and lower end portions, and defines an interior region. One of the deployable supports is pivotably coupled to the upper end portion of the elongate body, and the other deployable support is pivotably coupled to the lower end portion of the elongate body. The deployable supports are each positionable between an extended use position and a retracted transport position. A repositionable standoff member is pivotably coupled to the elongate body and is configured to engage the tree or pole, and to maintain a space between the elongate body and the tree or pole. The standoff member is repositionable between a substantially horizontal orientation for engaging the tree or pole, and a substantially vertical orientation along the elongate body for compact stowage and transport. The flexible elongate securing member is coupled to the elongate body and configured to wrap around the tree or pole to thereby attach the support thereto, wherein at least a portion of the flexible elongate securing member is stowed and secured in the interior region of the elongate body.

In still another form of the present invention, a support for supporting a user along a tree or pole includes an elongate body having upper and lower end portions, with a seating platform pivotably coupled to the upper end portion and a footrest platform pivotably coupled to the lower end portion, where the footrest platform defines an opening. An upper retractor is positioned at the upper end portion of the elongate body, and a lower retractor positioned at one of the footrest platform and the lower end portion of the elongate body. A flexible elongate securing member is mounted to each of the upper retractor and the lower retractor, and both flexible elongate securing members wrap around a tree or pole to thereby secure the support. The seating platform and the footrest platform are both positionable between an extended use position and a retracted transport position. When the footrest platform is in the retracted transport position, the upper retractor is accessible through the opening and is operable to tighten the flexible elongate securing member to thereby attach the support to the tree or pole.

Thus, the supports of the present invention provides a strong, secure, and stable climbing and support for use in scaling trees, poles, or the like, but which may be quickly and easily reconfigured to a self-contained and compact stowed configuration that is readily transported in a vehicle or by a person.

These and other objects, advantages, purposes, and features of the invention will become more apparent upon review of the following specification in conjunction with the drawings.

BRIEF DESCRIPTION OF THE DRAWINGS

FIG. 2 is another perspective view of the climbing support of FIG. 1;

FIG. 3 is an enlarged view of the region designated III in FIG. 2;

FIG. 9 is a perspective view of the lower subassembly of FIG. 7, shown in a collapsed transport configuration;

FIG. 10 is an enlarged view of the region designated X in FIG. 9;

Figure 47:
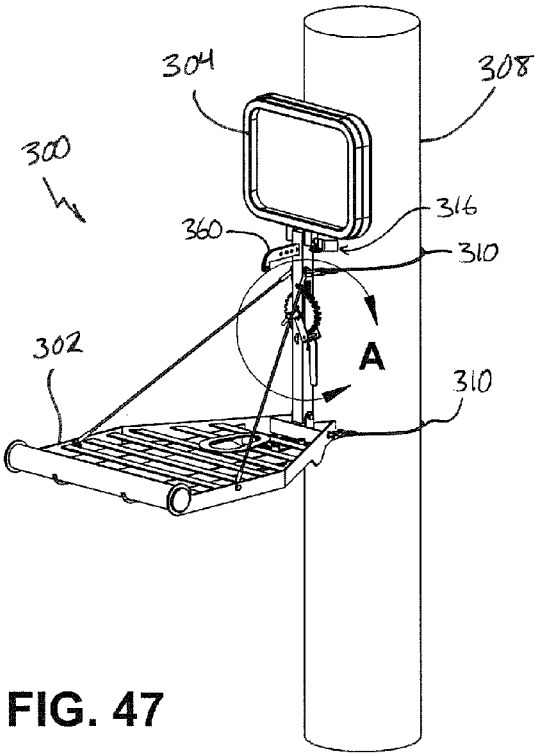
FIG. 47 is a left-side front perspective view of the tree stand of FIG. 45.
Figure 49:
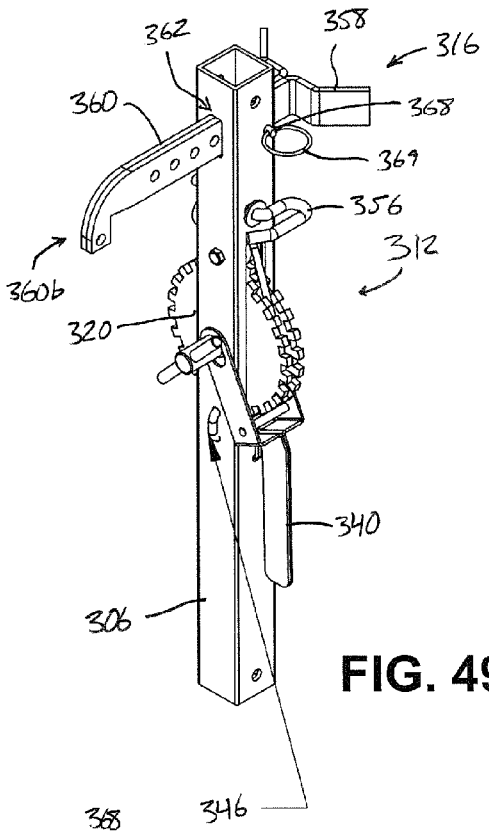
FIG. 49 is a top perspective view of a structural body and attachment mechanism of the tree stand, with the attachment mechanism in a locked position.
Figure 50:
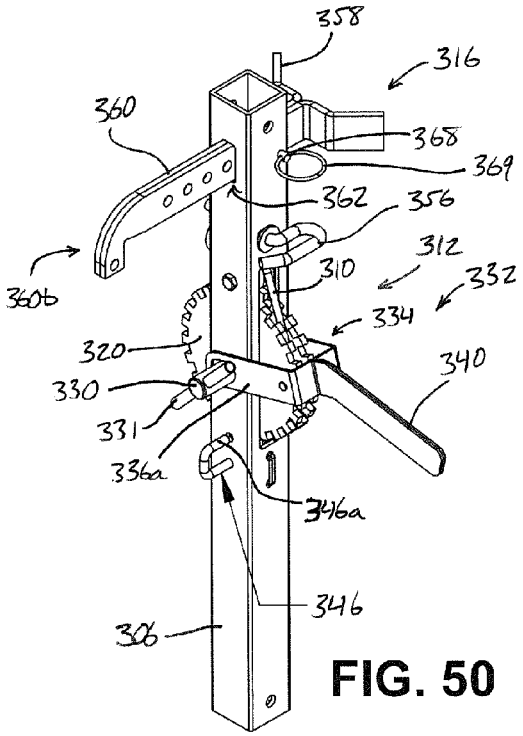
FIG. 50 is another top perspective view of a structural body and attachment mechanism of FIG. 49, with the attachment mechanism in an unlocked position.
Figure 53:
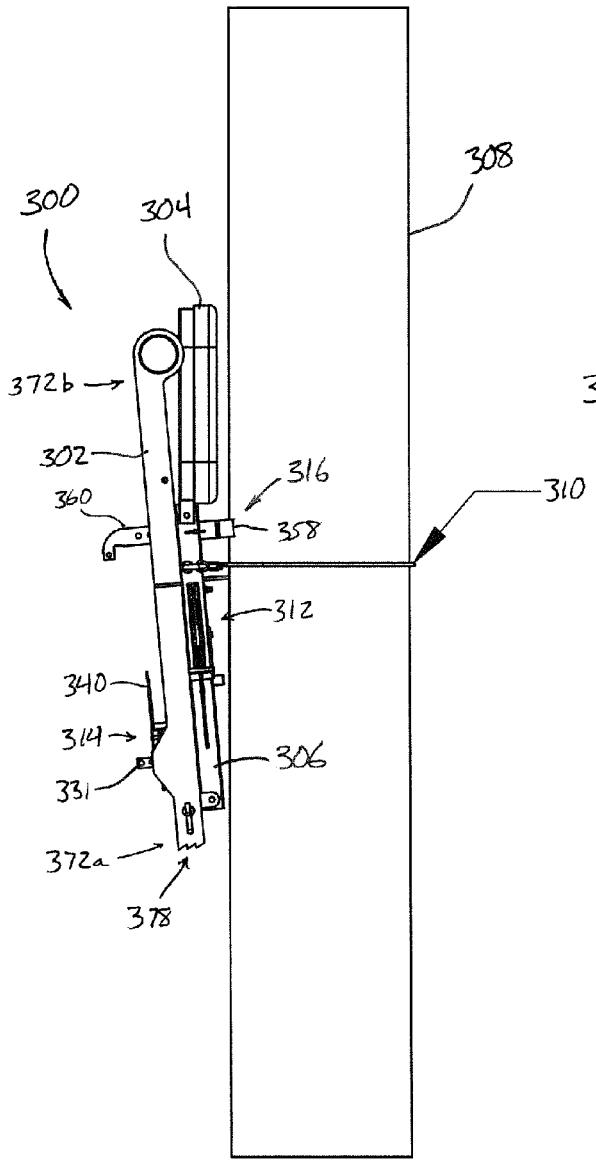
Figure 54:
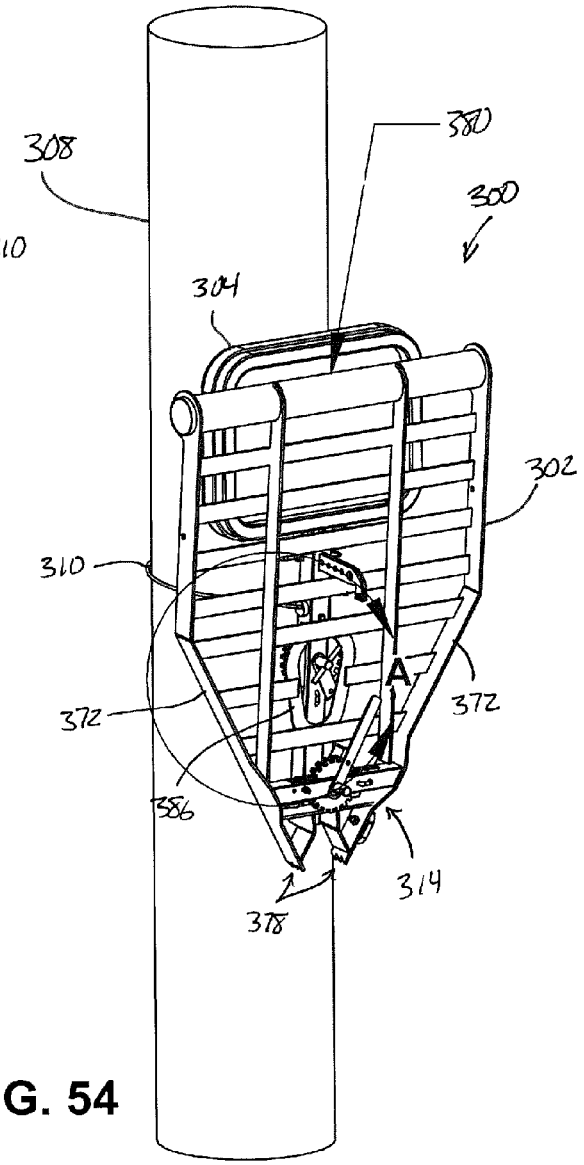
Figure 54A:
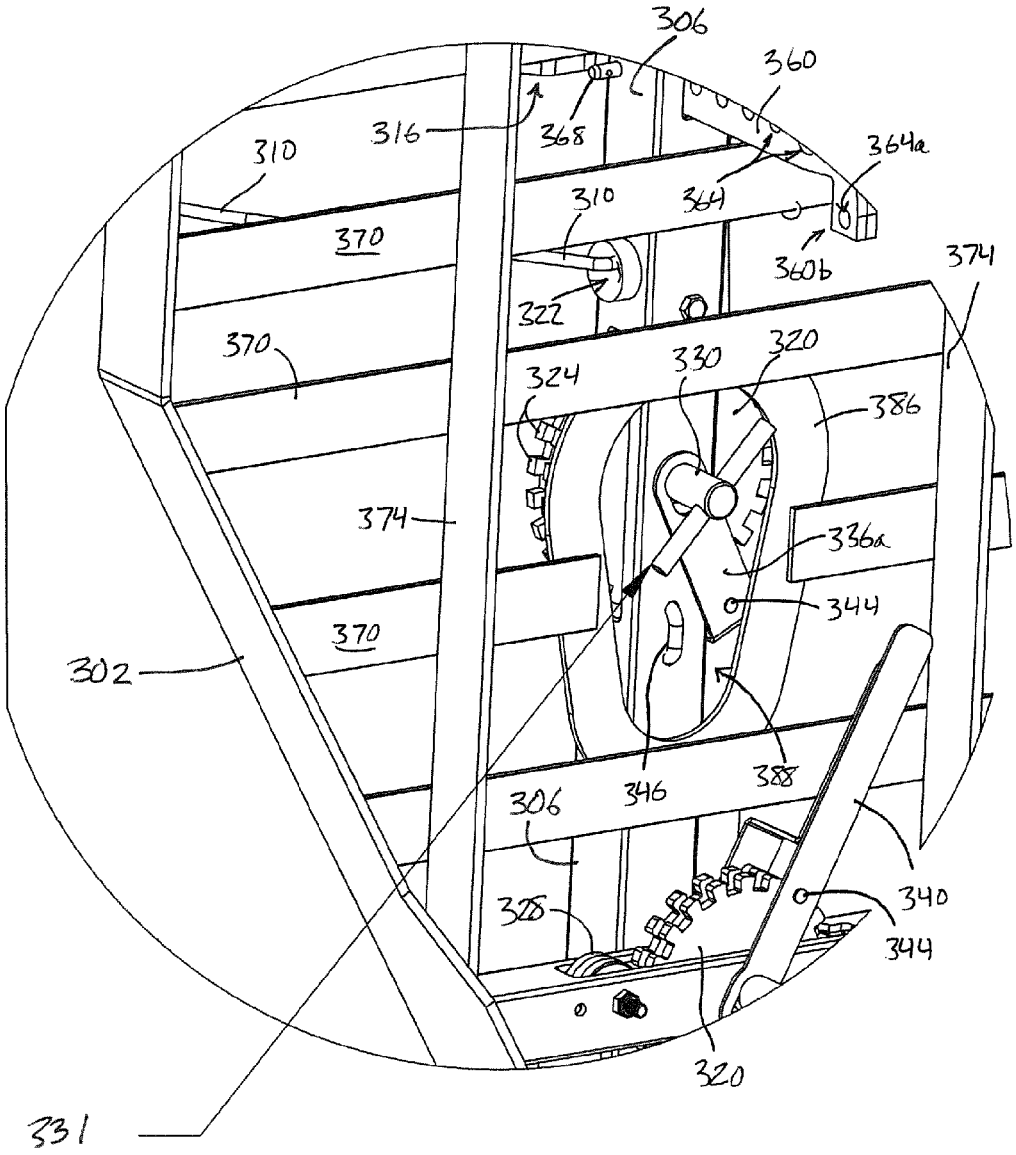
Figure 55:
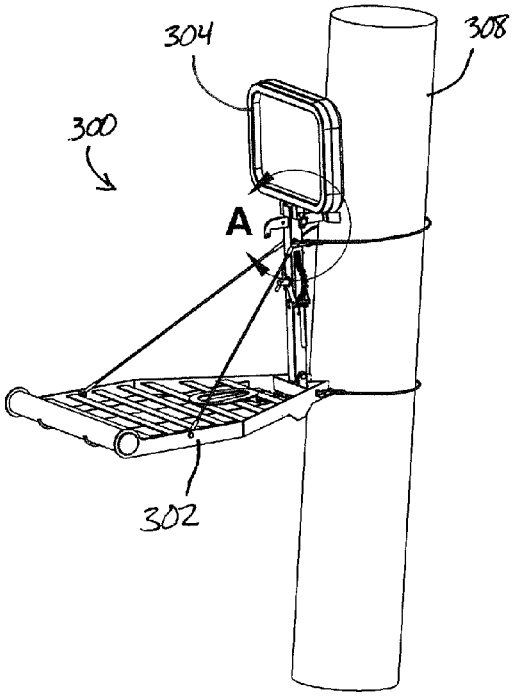
Figure 55A:
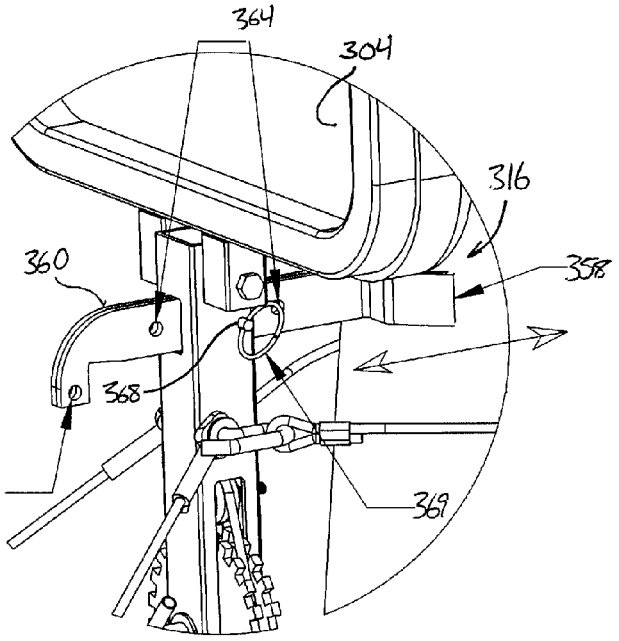
Figure 56:
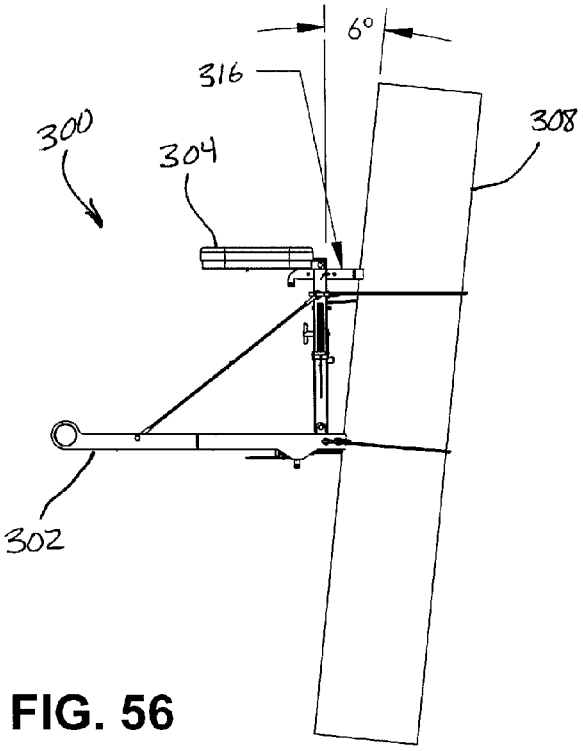
Figure 57:
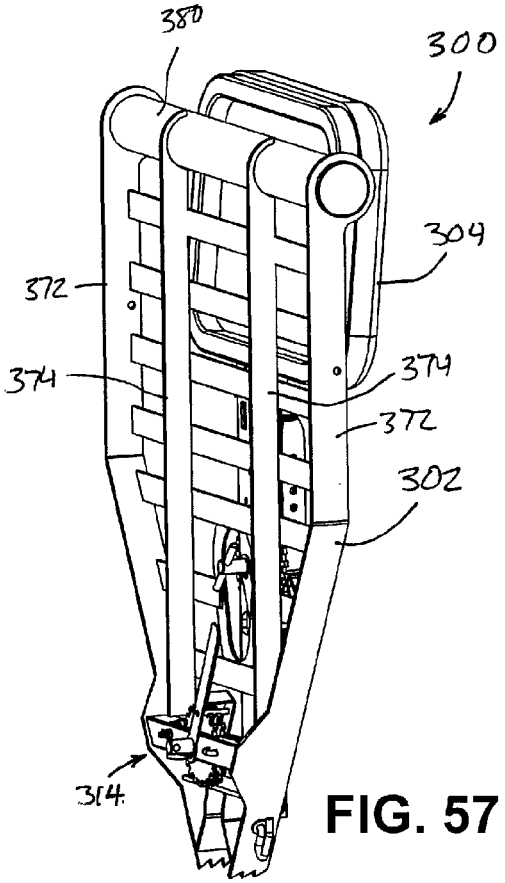
Figure 58:
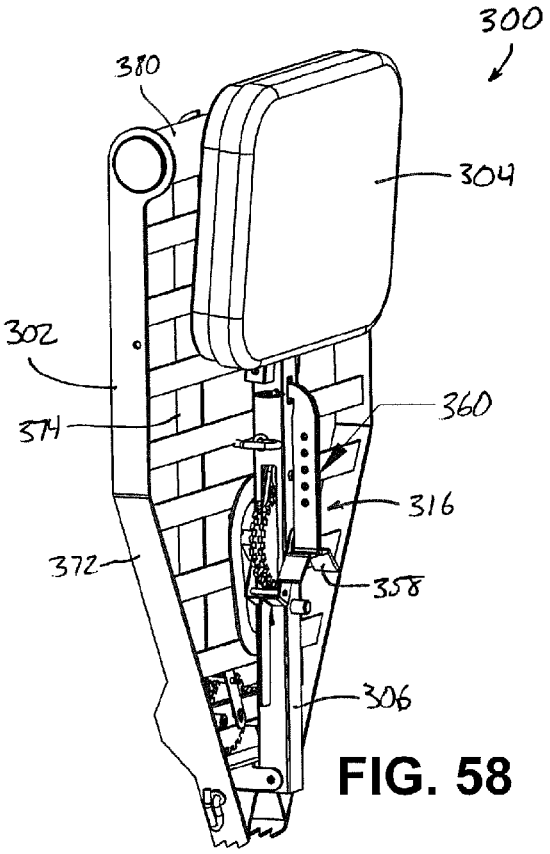
Figure 59:
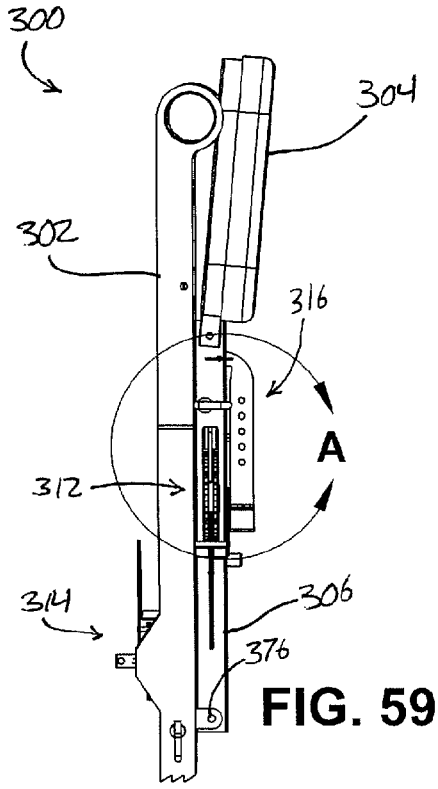
Figure 59A:
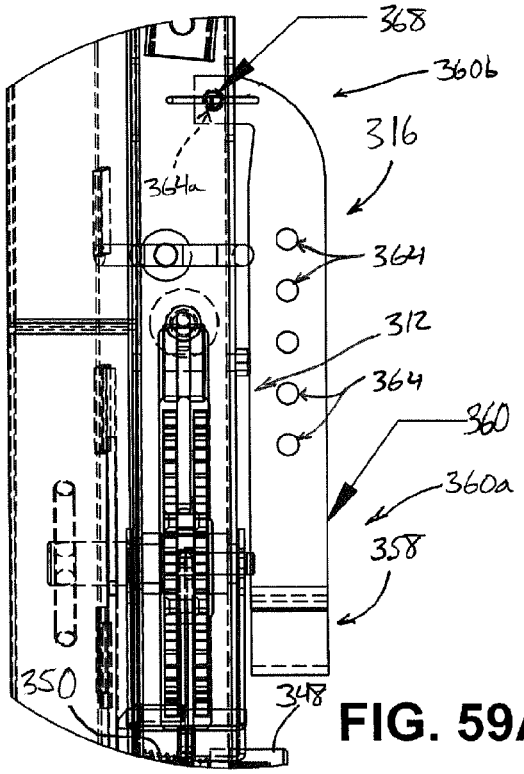
Figure 60:
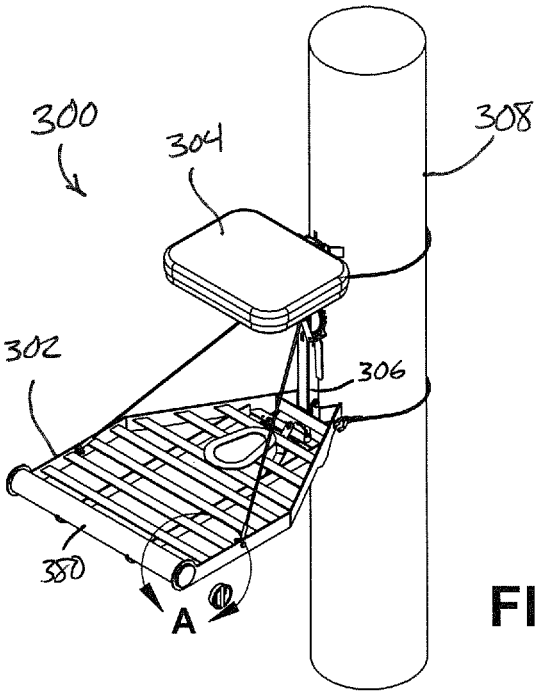
Figure 60A:
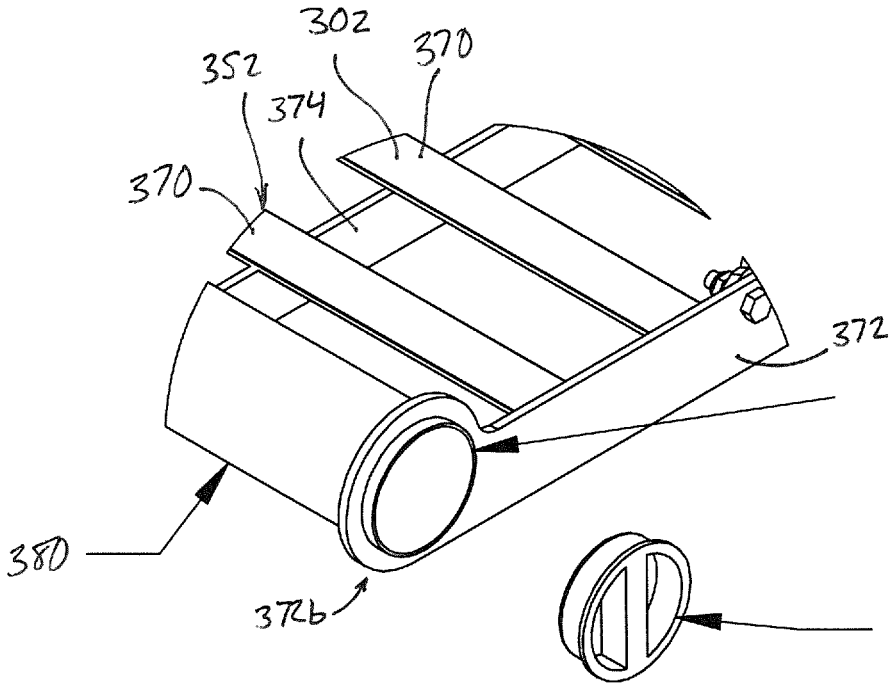

50, and showing internal structure;

FIG. 53 is a left side elevation of the tree stand of FIG. 49 shown partially secured to the tree or pole in a collapsed storage or transport configuration;

FIG. 54 is a front perspective view of the tree stand and tree or pole of FIG. 53;

FIG. 54A is an enlarged view of the area designated 'A' in FIG. 54;

FIG. 55 is another left-side front perspective view of the tree stand of FIG. 47;

FIG. 55A is an enlarged view of the area designated 'A' in FIG. 55;

FIG. 56 is a left side elevation of the tree stand of FIG. 49, shown attached to a rearward-leaning tree or pole;

FIG. 57 is a left-side perspective view of the tree stand of FIG. 49 in its collapsed storage or transport configuration;

FIG. 58 is a right-side perspective view of the tree stand of FIG. 57;

FIG. 59 is a right side elevation of the tree stand of FIG. 57;

FIG. 59A is an enlarged view of the area designated 'A' in FIG. 59;

FIG. 60 is a left-side top perspective view of the tree stand of FIG. 47; and FIG. 60A is an enlarged view of the area designated 'A' in FIG. 60.

DESCRIPTION OF THE PREFERRED EMBODIMENTS

Figure 1:
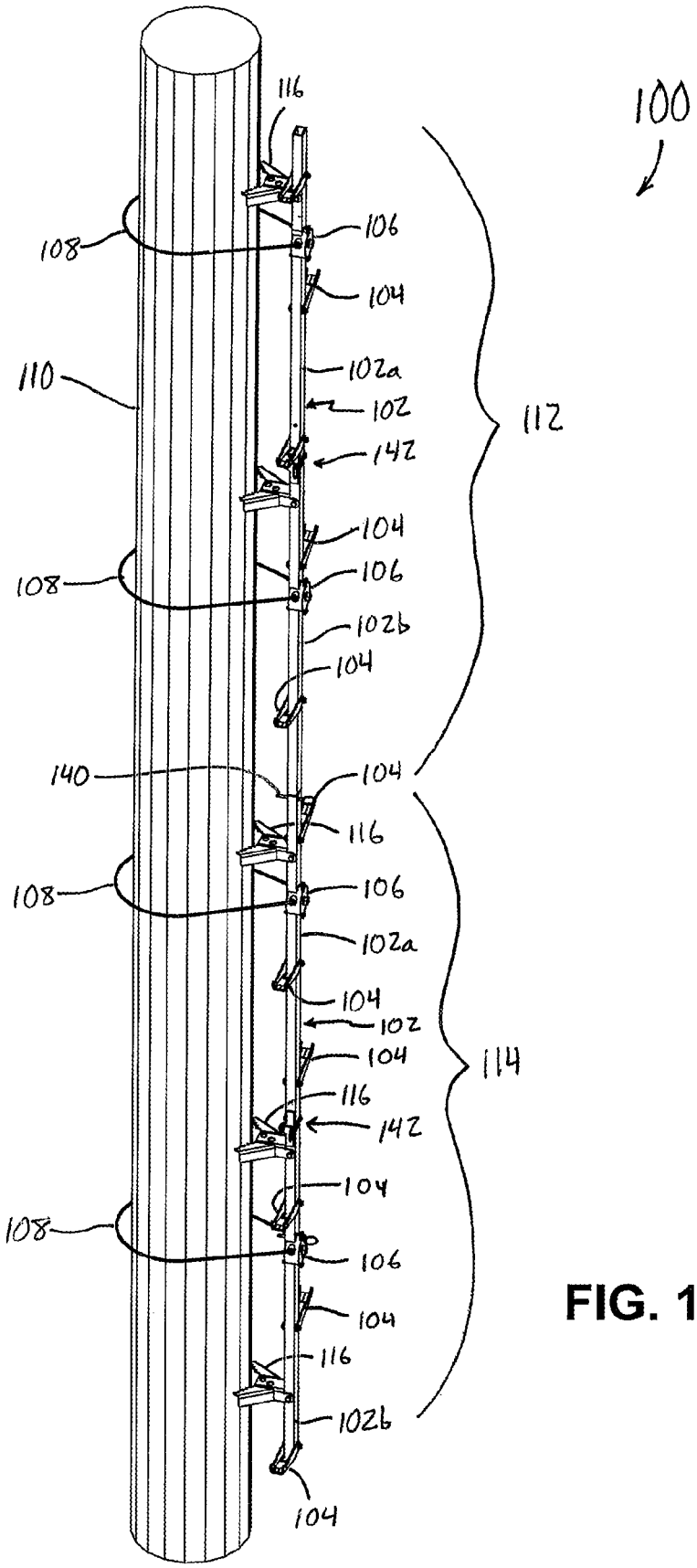
FIG. 1 is a perspective view of a climbing support assembly in accordance with the present invention, shown attached to a tree or pole.
Figure 4:
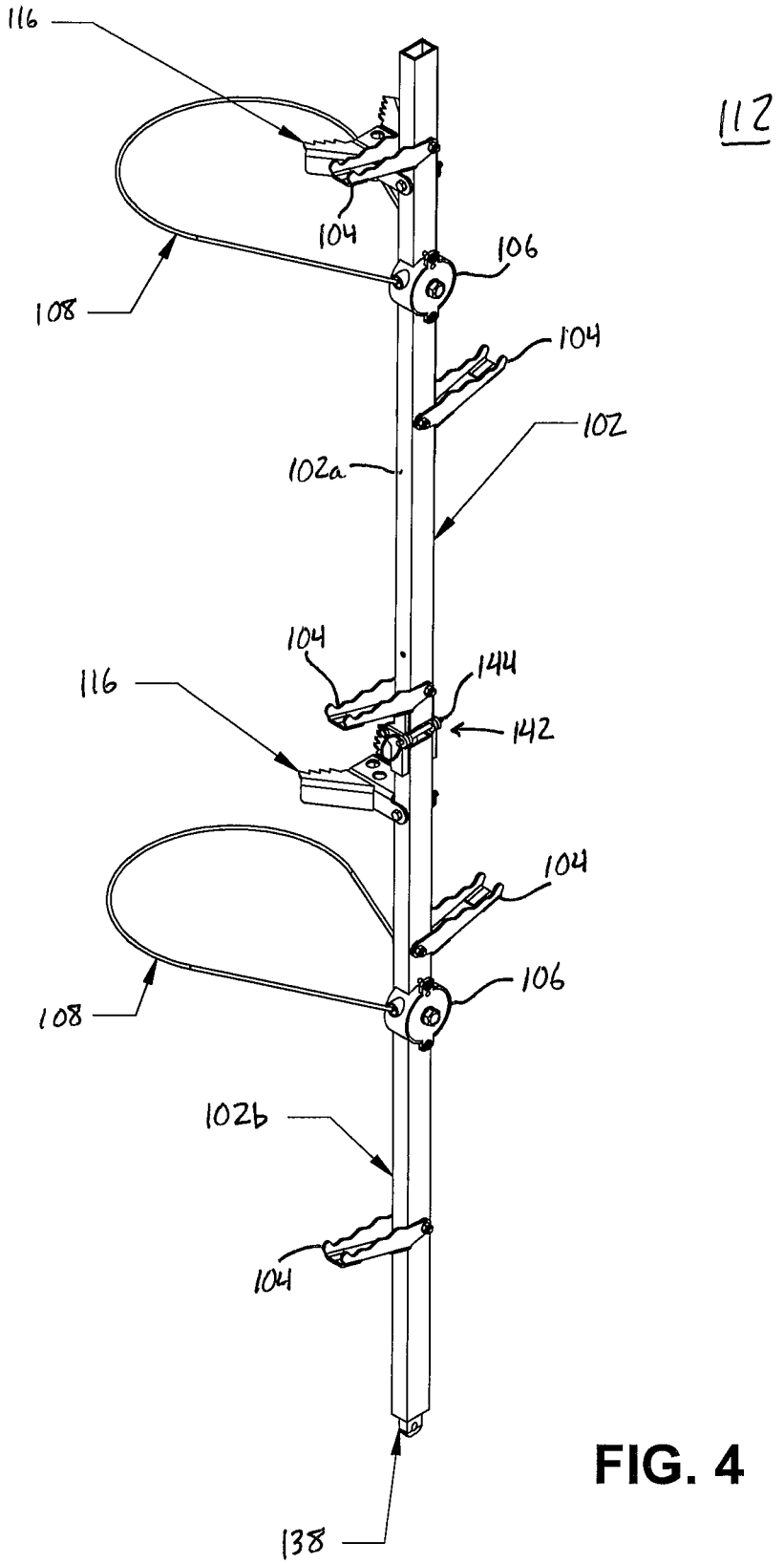
FIG. 4 is a perspective view of an upper subassembly of the climbing support of FIG. 1.
Figure 5:
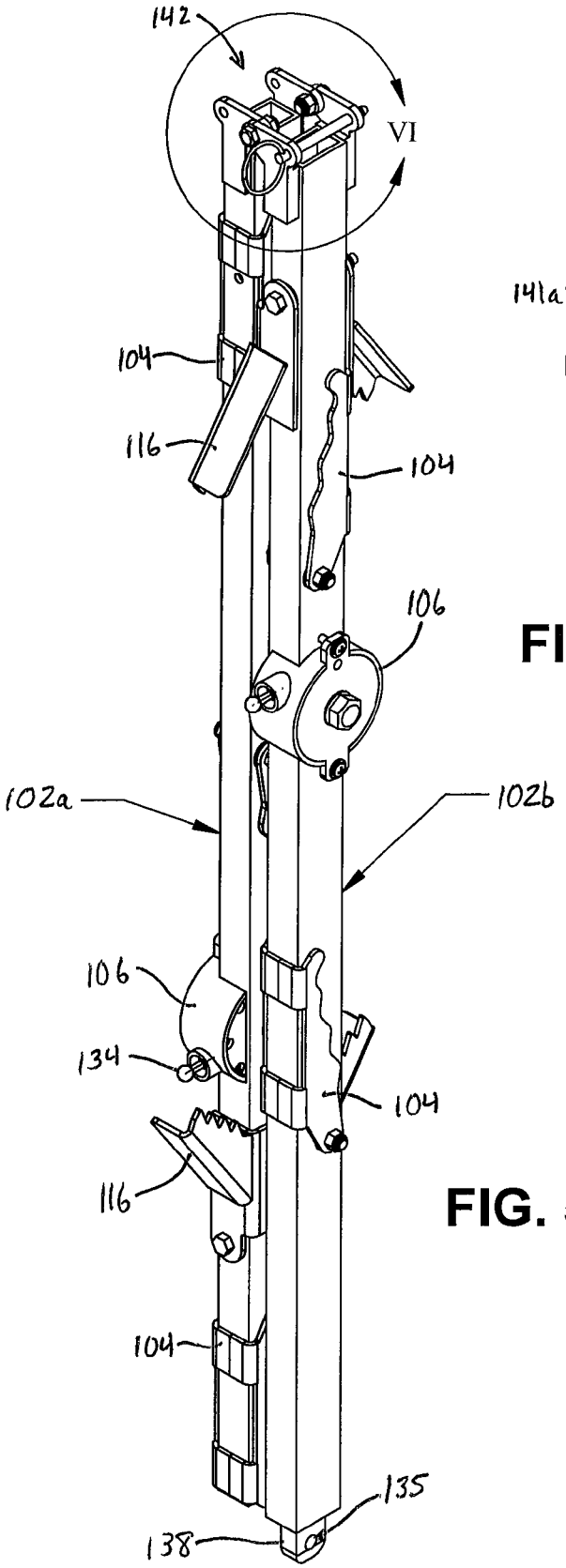
FIG. 5 is a perspective view of the upper subassembly of FIG. 4, shown in a collapsed transport configuration.

Referring now to the drawings and the illustrative embodiments depicted therein, a climbing support assembly 100, which may also be referred to as a "climbing stick," includes a main frame member in the form of an elongate body 102, a plurality of foot supports or steps or step members 104, a retractor 106, and a cable, cord, strap, or other flexible securing member 108 for selectively securing climbing support assembly 100 to a tree or pole 110 or the like, including substantially any vertical or generally vertical object or surface, such as shown in FIG. 1. Climbing support assembly 100 is configurable between an extended "use" configuration (FIGS. 1 and 2) in which the support assembly may be secured to a tree via flexible securing member 108, which is extendable and retractable on the retractor for that purpose, and a storage or transport configuration (FIGS. 5 and 9) in which the support assembly is considerably more compact. To simplify the remaining description, the term "tree" will generally be used hereafter to refer to any tree or pole, although it will be appreciated that other objects or surfaces are envisioned.

Figure 15:
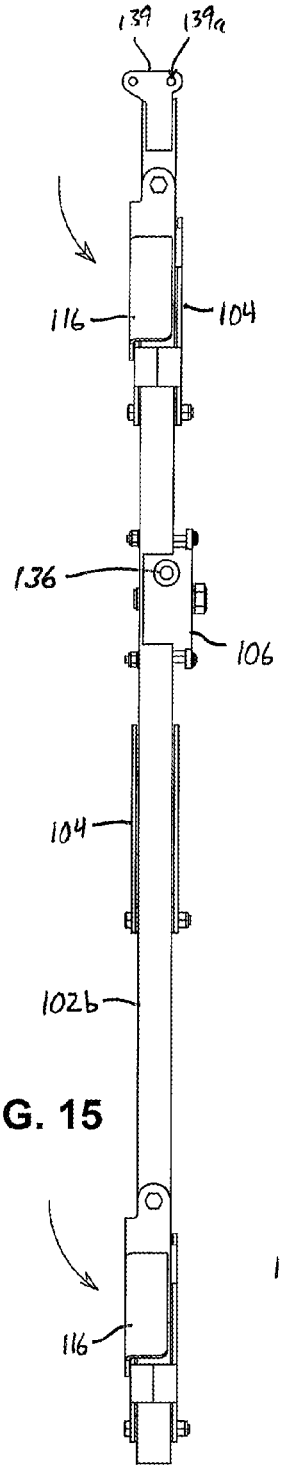
FIG. 15 is a left side elevation of the lower subassembly portion of FIG. 11, shown in the collapsed transport configuration.
Figure 16:
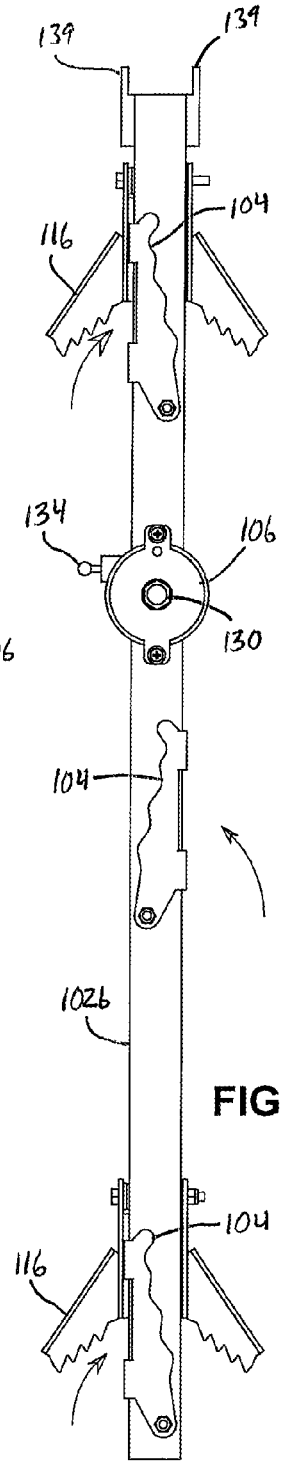
FIG. 16 is a front elevation of the lower subassembly portion of FIG. 15.
Figure 17:
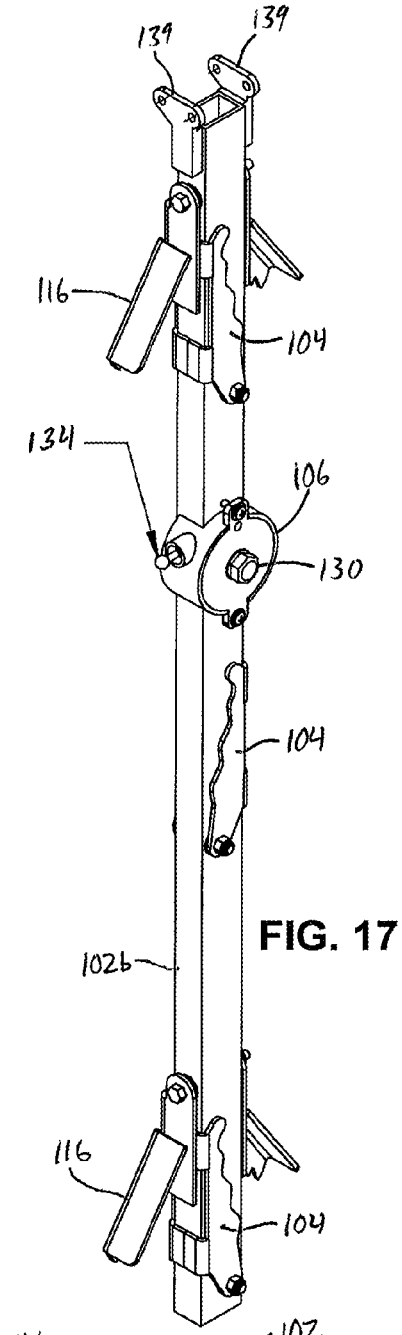
FIG. 17 is a perspective view of the lower subassembly portion of FIG. 15.
Figure 18:
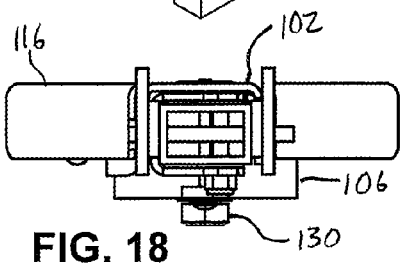
FIG. 18 is a top plan view of the lower subassembly portion of FIG. 15.
Figure 23:
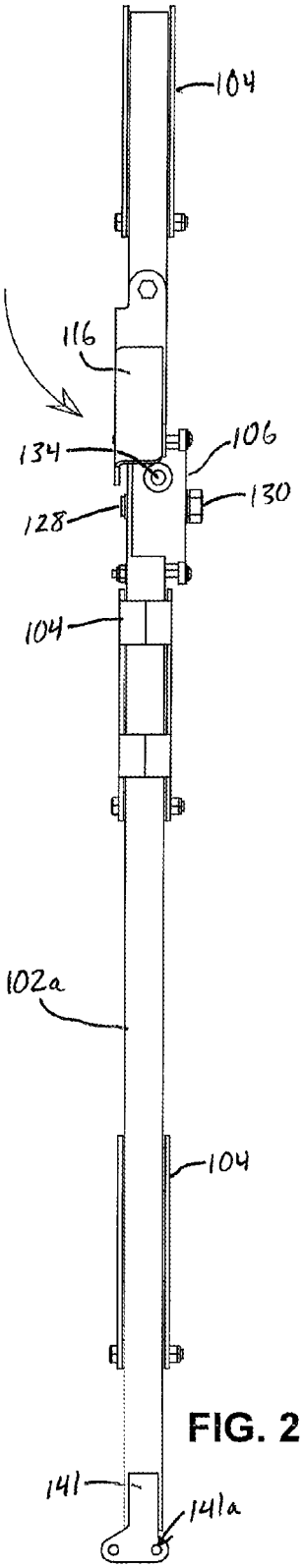
FIG. 23 is a left side elevation of the upper subassembly portion of FIG. 22, shown in the collapsed transport configuration.
Figure 24:
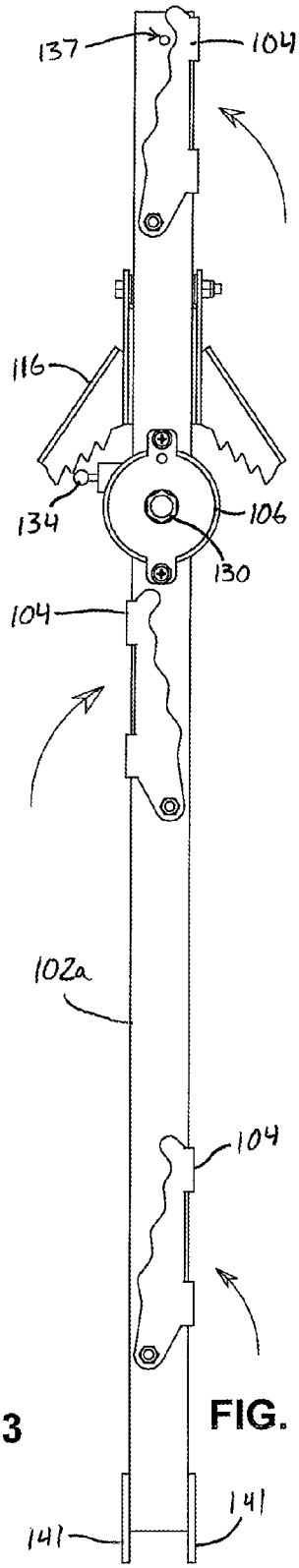
FIG. 24 is a front side elevation of the upper subassembly portion of FIG. 23.
Figure 25:
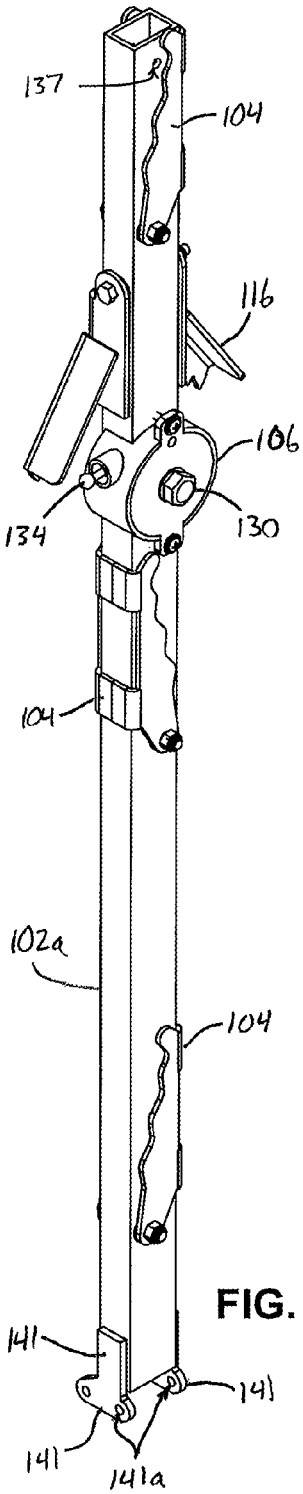
FIG. 25 is a perspective view of the upper subassembly portion of FIG. 23.
Figure 26:
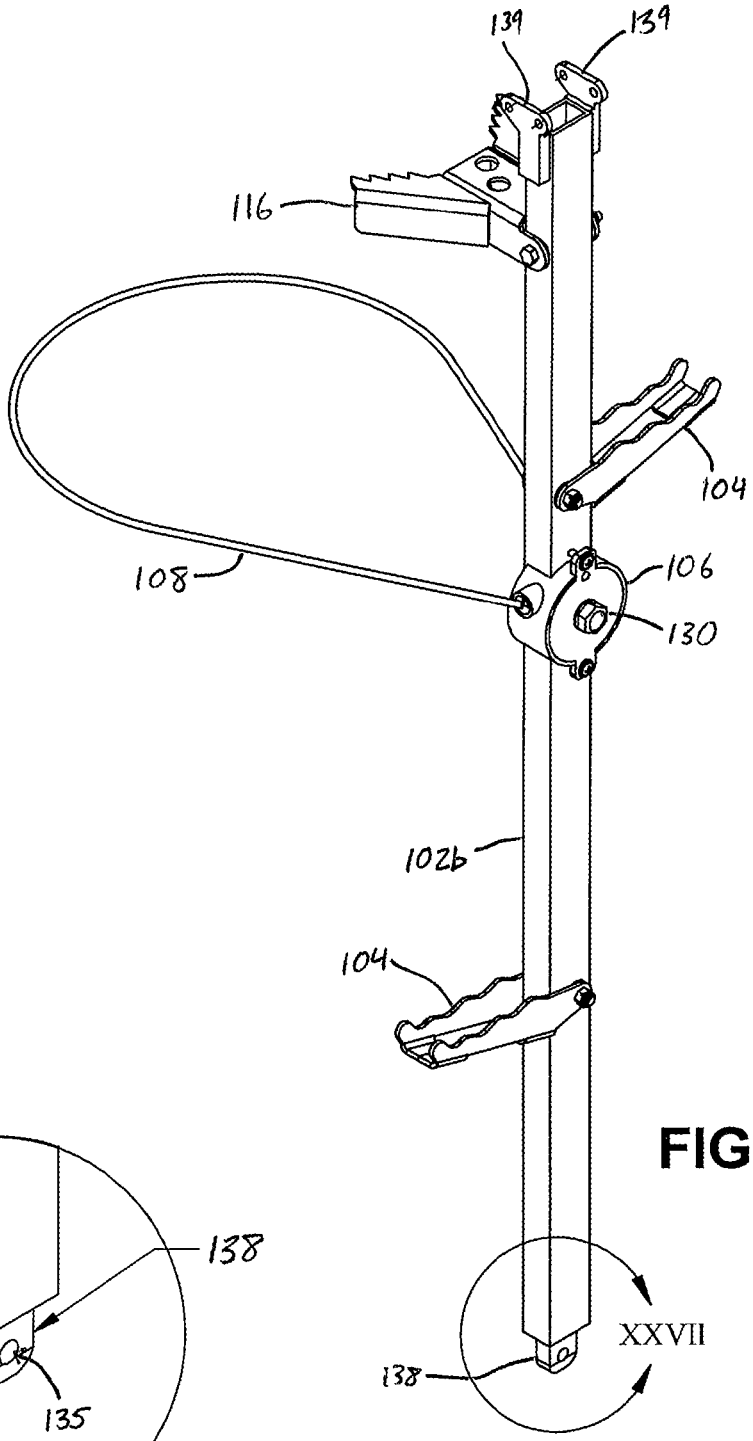
FIG. 26 is a perspective view of a lower portion of the upper subassembly of FIG. 4.
Figure 27:
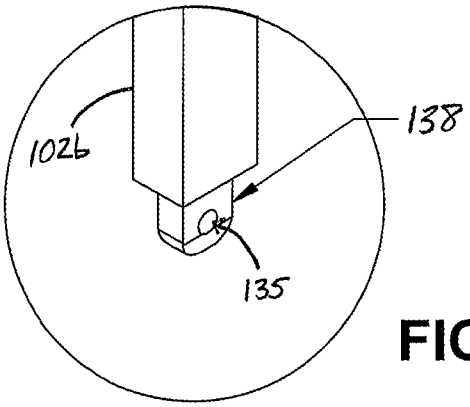
FIG. 27 is an enlarged view of the region designated XXVII in FIG. 26.
Figure 28:
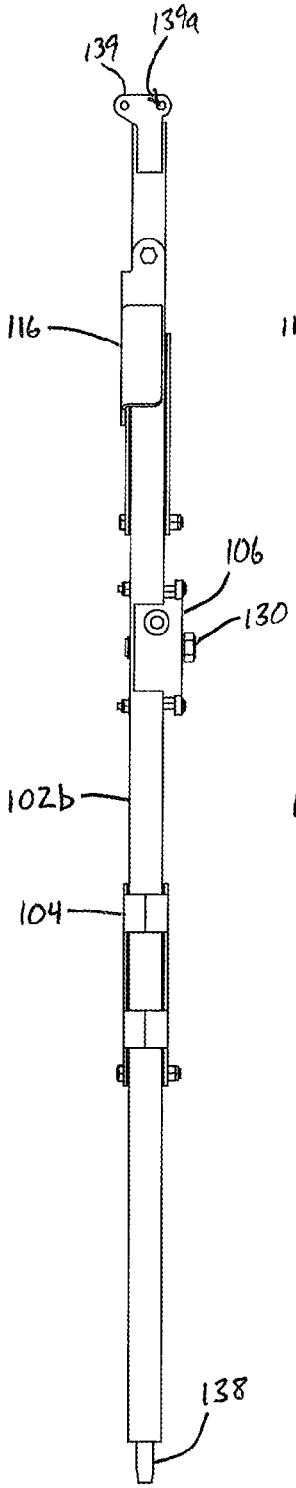
FIG. 28 is a left side elevation of the lower subassembly portion of FIG. 26, shown in the collapsed transport configuration.
Figure 29:
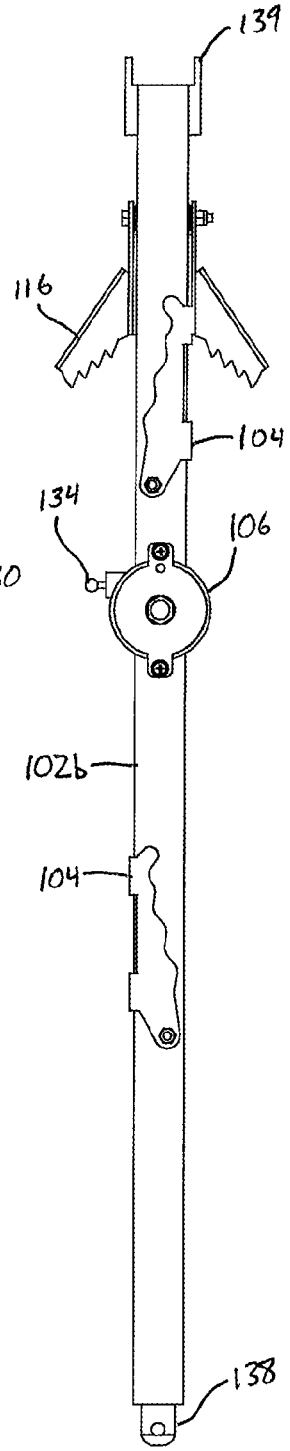
FIG. 29 is a front side elevation of the lower subassembly portion of FIG. 28.
Figure 30:
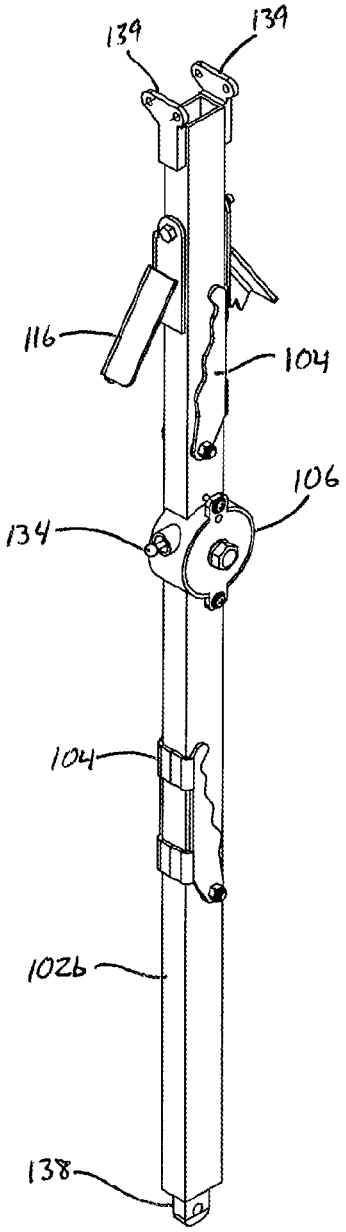
FIG. 30 is a perspective view of the lower subassembly portion of FIG. 28.
Figure 31:
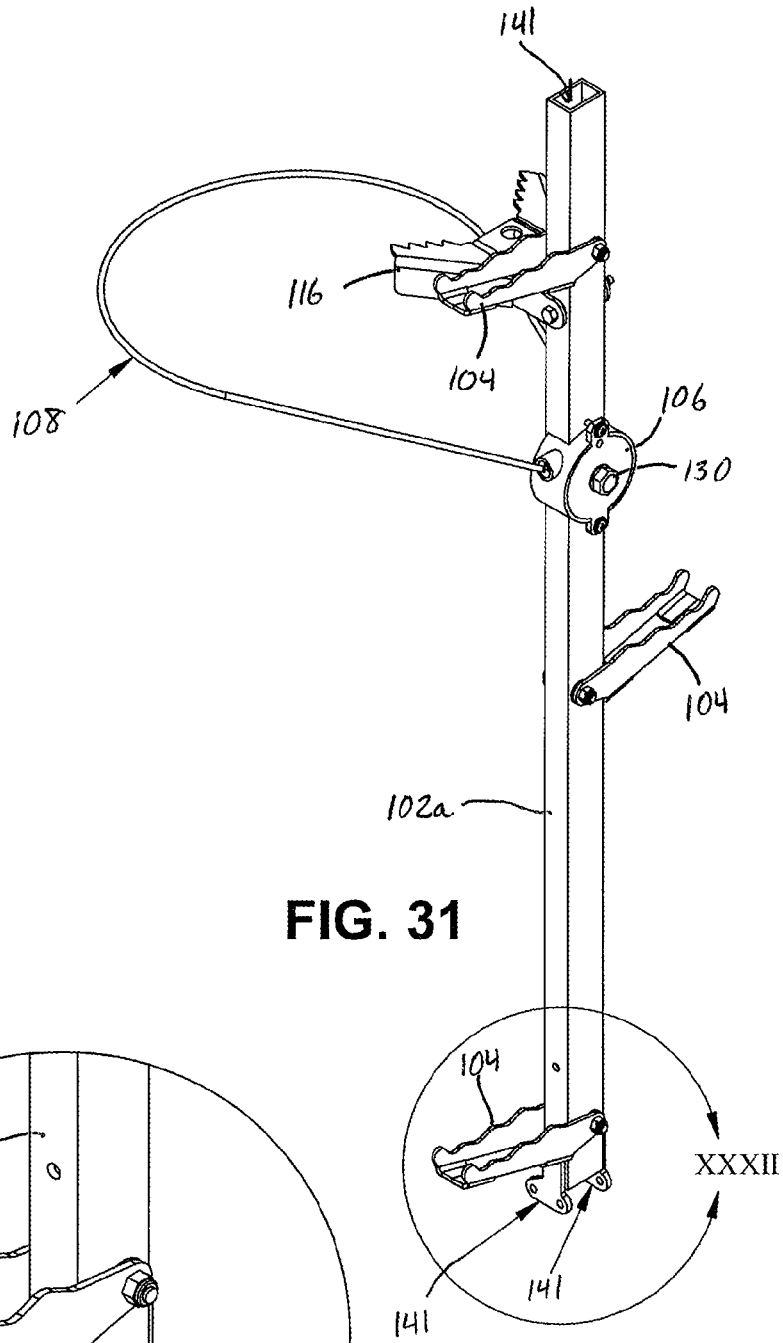
FIG. 31 is a perspective view of an upper portion of the upper subassembly of FIG. 4.
Figure 32:
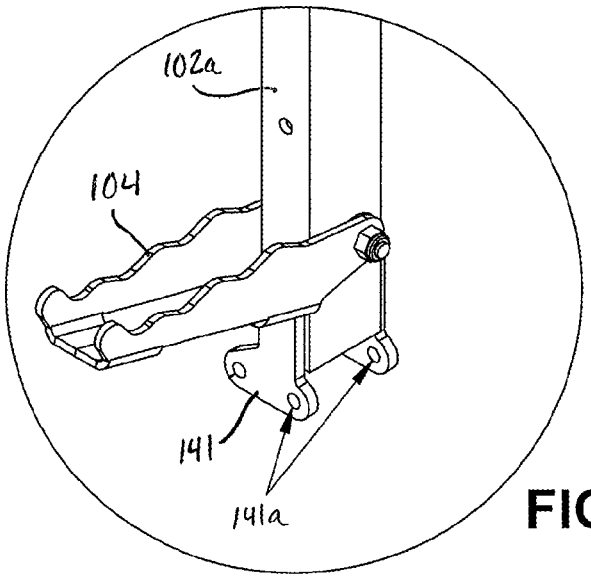
FIG. 32 is an enlarged view of the region designated XXXII in FIG. 31.
Figure 33:
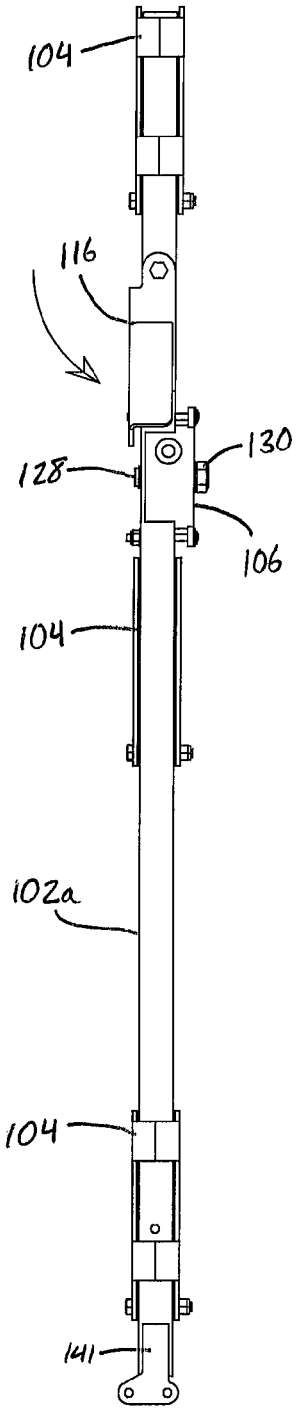
FIG. 33 is a left side elevation of the upper subassembly portion of FIG. 31, shown in the collapsed transport configuration.
Figure 34:
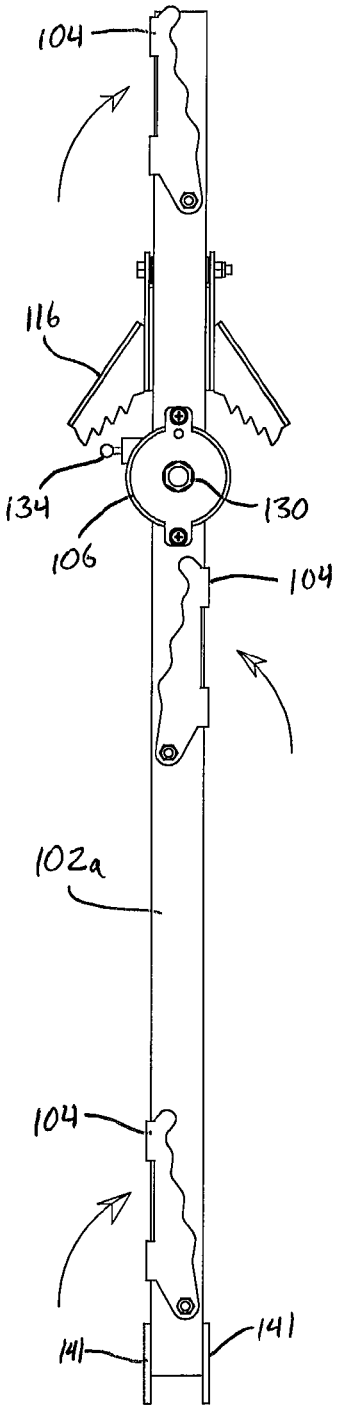
FIG. 34 is a front side elevation of the upper subassembly portion of FIG. 33.
Figure 35:
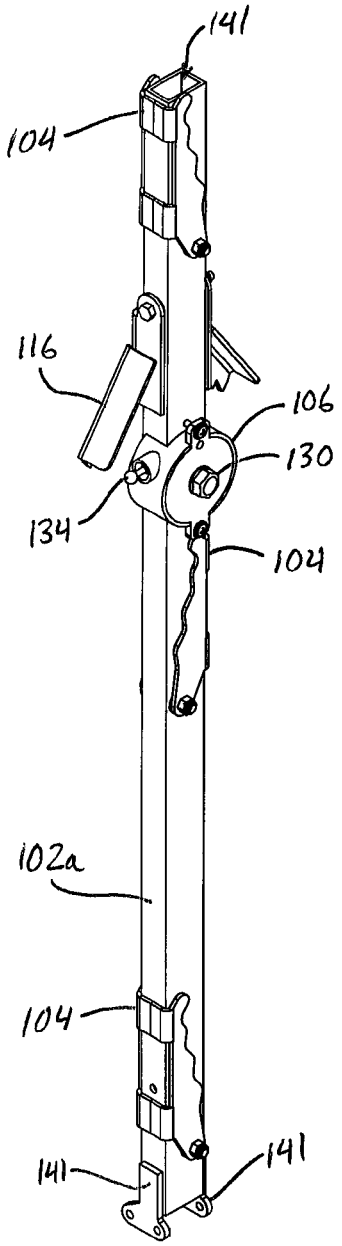
FIG. 35 is a perspective view of the upper subassembly portion of FIG. 33.
Figures 36, 37, 38, 39, 40:
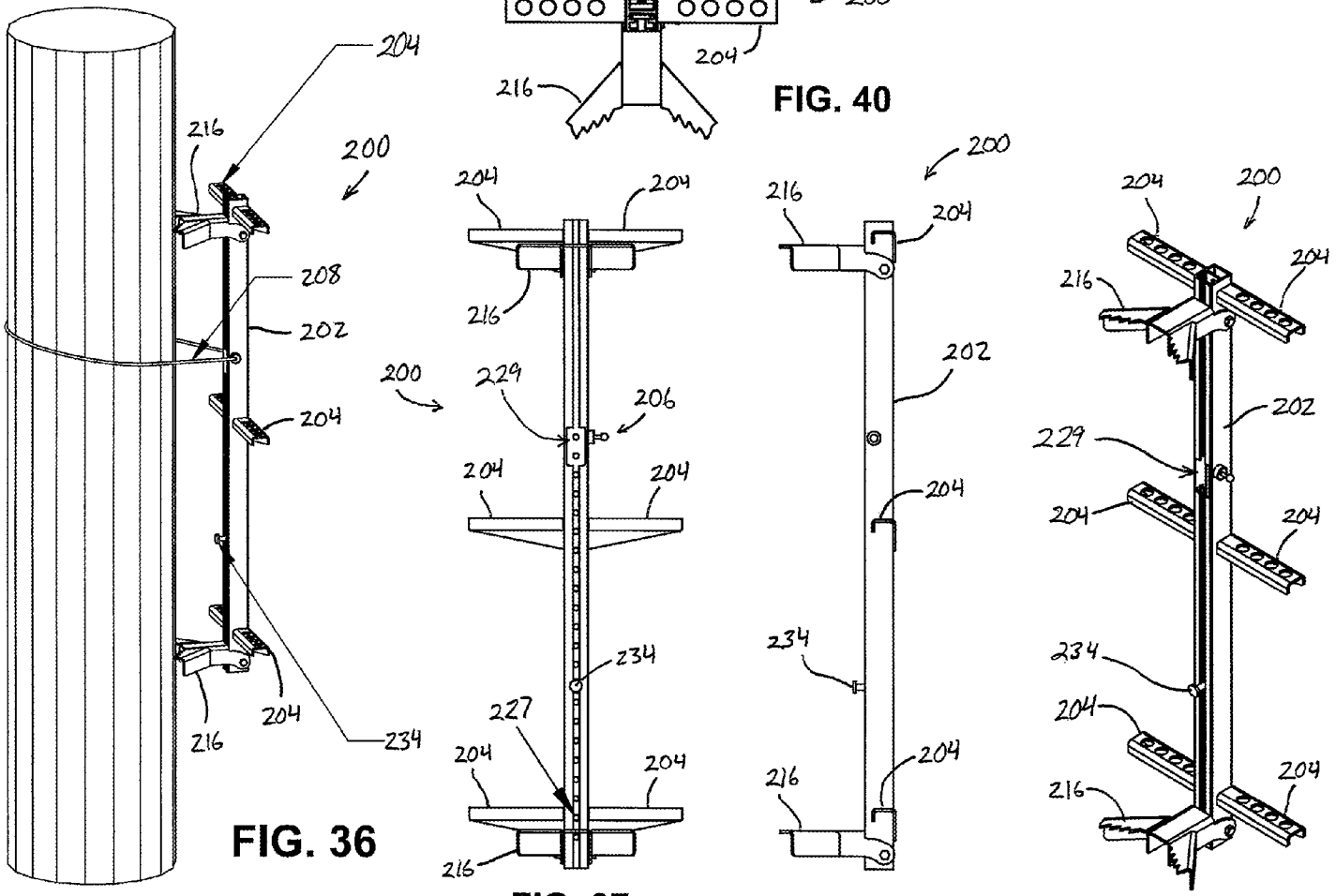
FIG. 36 is a perspective view of another climbing support assembly in accordance with the present invention, shown attached to a tree or pole.
FIG. 37 is a rear elevation of the climbing support of FIG. 36.
FIG. 38 is a left side elevation of the climbing support of FIG. 36.
FIG. 39 is a rear perspective view of the climbing support of FIG. 36.
FIG. 40 is a top plan view of the climbing support of FIG. 36.

In the illustrated embodiment, climbing support assembly 100 includes an upper climbing support subassembly 112 and a lower climbing support subassembly 114 that can be coupled together in series at their respective elongate bodies 102, such as shown in FIGS. 1 and 2. Each climbing support subassembly 112, 114 includes a plurality of standoffs or "offsets" 116 that are positionable so as to project or extend perpendicularly outwardly from each elongate body 102 and engage the tree 110, to provide adequate room between the tree 110 and the steps 104 and elongate body 102, and so that a user can readily grasp these components of the climbing support assembly with the hands and place a foot solidly on each step 104. Standoffs 116 are pivotably coupled to the elongate bodies 102 and are repositionable between a substantially horizontal orientation for engaging the tree or pole 110 (FIGS. 1 and 2), and a substantially vertical orientation along the elongate body 102 for compact stowage and transport (FIGS. 5, 9, 15-18, 23-25, 28-30, and 33-35). In the illustrated embodiment, and as shown with curved arrows in FIGS. 15, 23, and 33, standoffs 116 pivot downwardly from the horizontal orientation to the vertical (stowed) configuration, and cannot pivot upwardly beyond the horizontal orientation. This allows the standoffs 116 to work in concert with flexible securing members 108 to support the weight of support assembly 100 and a user (position thereon) along the tree 110, as will be described in more detail below.

Similar to the standoffs 116, the steps 104 are pivotably coupled to the elongate body 102 between an outwardly-extending position for use as a hand-hold or foot support (FIGS. 1 and 2), and a retracted position for compact stowage along the elongate body 102 (FIGS. 5, 9, 15-18, 23-25, 28-30, and 33-35). Steps 104 are generally U-shaped in cross section, and define an opening that faces upwardly when the steps are deployed to the outwardly-extending position, and that faces inwardly to receive a portion of elongate body 102 in the compact stowage position. Steps pivot upwardly from the outwardly-extending position to the compact stowage position, such as shown with curved arrows in FIGS. 16, 24, and 34, and cannot pivot downwardly beyond the outwardly-extending position, which permits the steps to support substantial weight when they are deployed.

Figure 14:
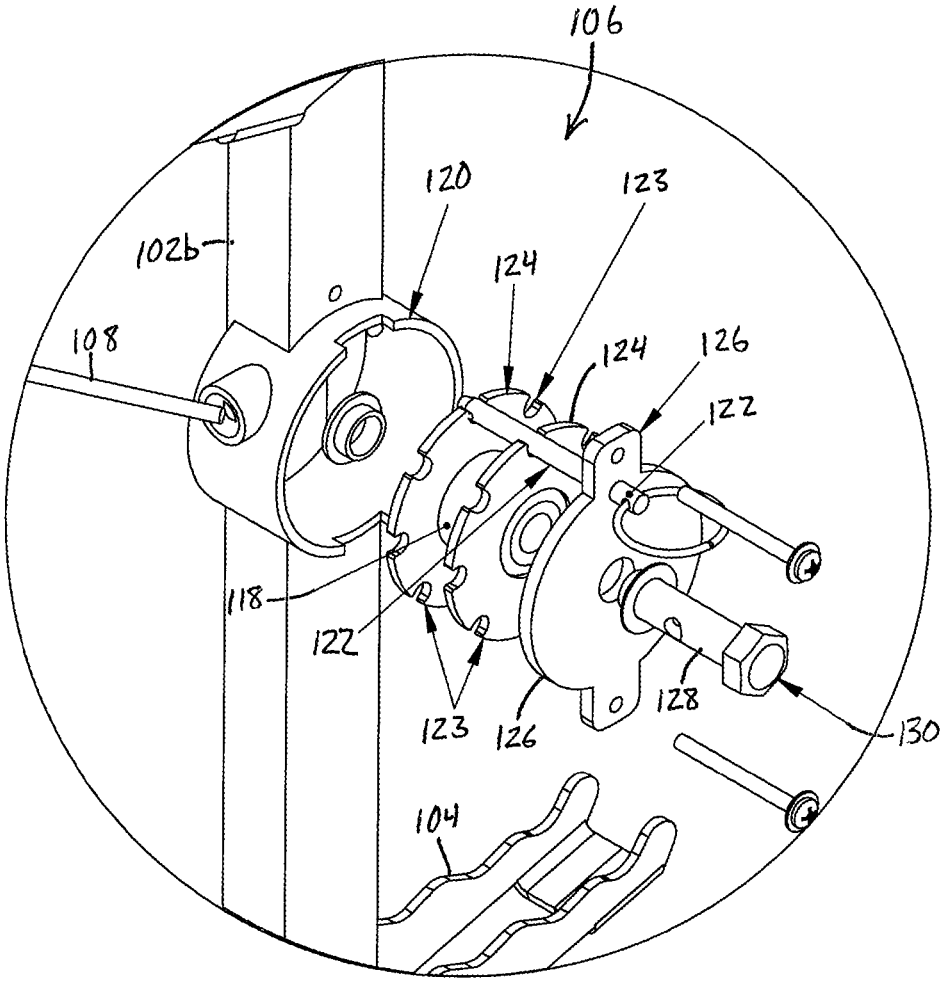
FIG. 14 is an enlarged view of the region designated XIV in FIG. 13.

Retractor 106 includes a spool 118 (FIG. 14) for selectively winding and unwinding the flexible securing member 108 between retracted and extended configurations. In the illustrated embodiment, retractor 106 is received in a cut-away portion of elongate body 102, and includes an outer casing or housing 120 that may be welded to elongate body 102, or attached in a different manner, so that outer casing 120 provides structural support in place of the cut-away portion of elongate body 102. Retractor 106 includes a lock member or pin 122 for selectively securing the spool 118 against rotation by engaging slots or openings 123 formed or established in circular plates 124 on either end of spool 118, while also engaging holes formed in a retractor cover plate 126 and in a rear surface of elongate body 102 (FIG. 14). Optionally, it is envisioned that the retractor could be coupled to the outside of elongate body 102, thereby negating the potential loss of structural strength of removing a portion of the elongate body, or the retractor could be incorporated directly into the elongate body, without departing from the spirit and scope of the present invention. It is further envisioned that different types of retractors may be used, such as spring-loaded self-rewinding retractors, for example.

Figure 12:
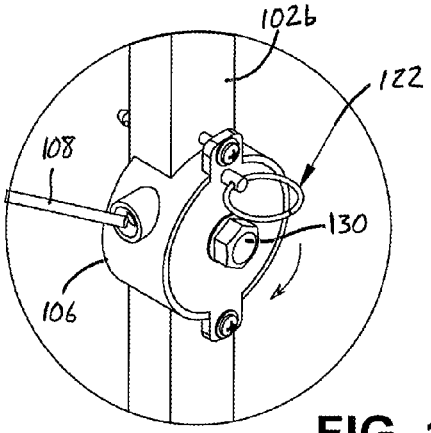
FIG. 12 is an enlarged view of the region designated XII in FIG. 11.
Figure 21:
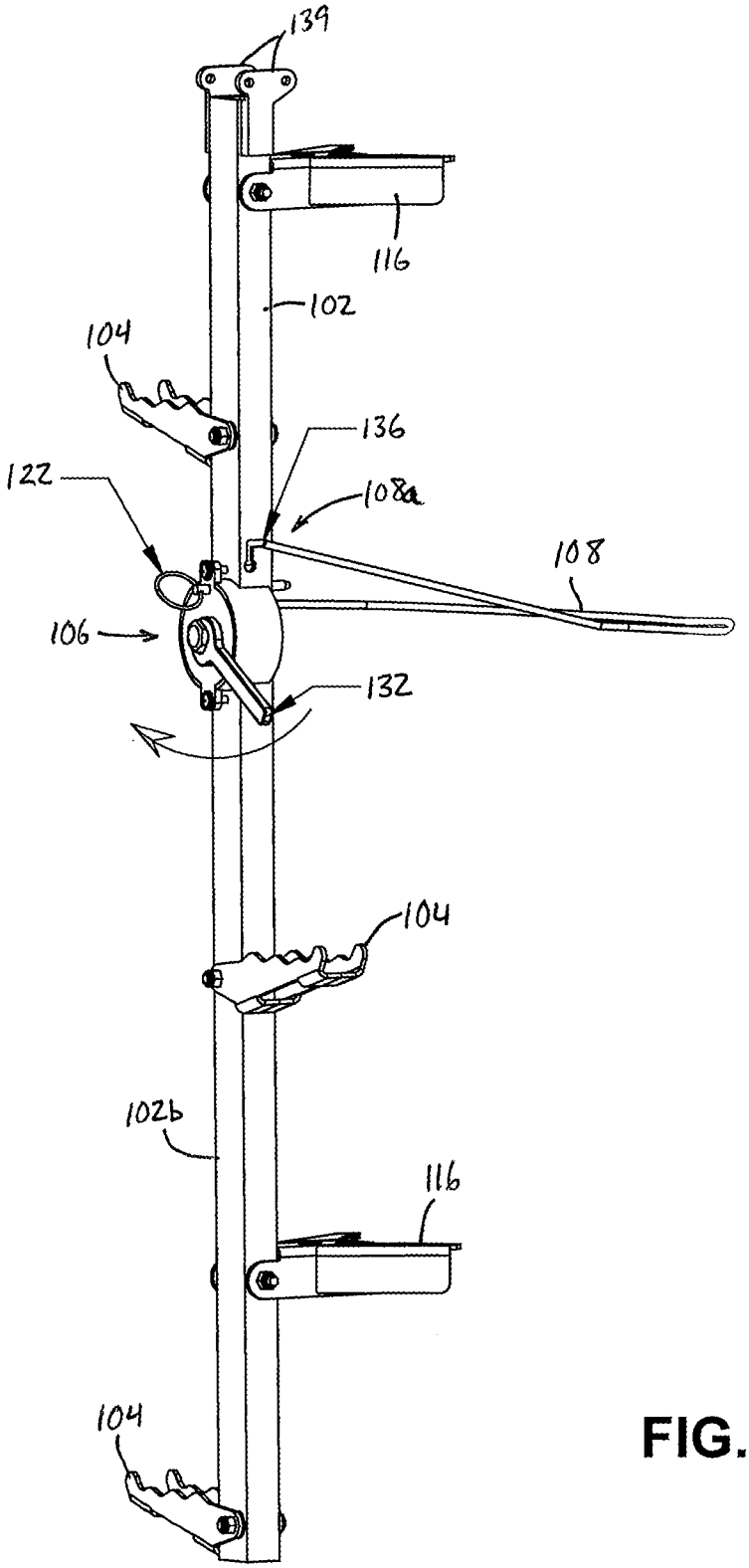
FIG. 21 is a rear perspective view of the lower subassembly portion of FIG. 19, showing a subsequent step of securing the cable end for attaching the assembly to a tree or pole.
Figure 22:
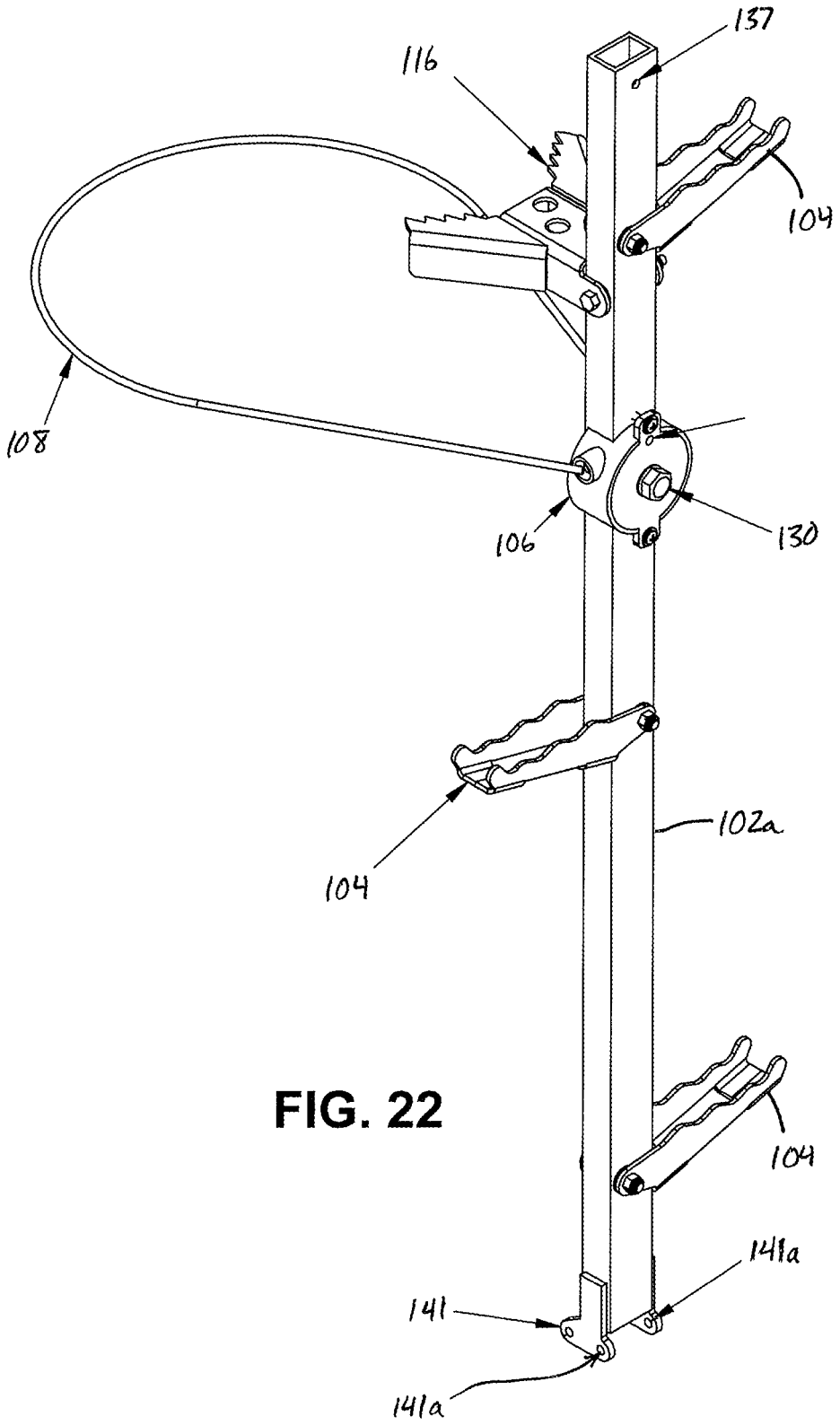
FIG. 22 is a perspective view of an upper portion of the lower subassembly of FIG. 7.

Retractor 106 includes a spindle 128 that extends through spool 118 and rotates with the spool, relative to casing 120 and elongate body 102, and includes a tool-engaging head portion 130 (FIG. 14) to facilitate manual rotation of the spool 118 with a tool such as a wrench 132 or the like (FIGS. 12 and 21). Optionally, a winding handle may be permanently attached to the retractor spindle, similar to the crank arm associated with a screw fastener that is shown and described in commonly-owned U.S. patent application, Ser. No. 13/275,408, filed Oct. 18, 2011, now U.S. Pat. No. 9,409,055, issued Aug. 9, 2016, and entitled TREE CLIMBING SUPPORT, which is hereby incorporated herein by reference in its entirety. Optionally, it is envisioned that other types of retractors could be used, such as automatic winding retractors including a spring for biasing the spool to rotate in a manner that winds and tensions the flexible securing member onto the spool, and/or including a ratcheting mechanism for securing the spool against unintended unwinding of the flexible securing member. Retractor 106 may be configured to operate with substantially any type of flexible securing member 108, such as a rope, cord, cable, strap, chain, or the like, or a combination of those.

Figure 19:
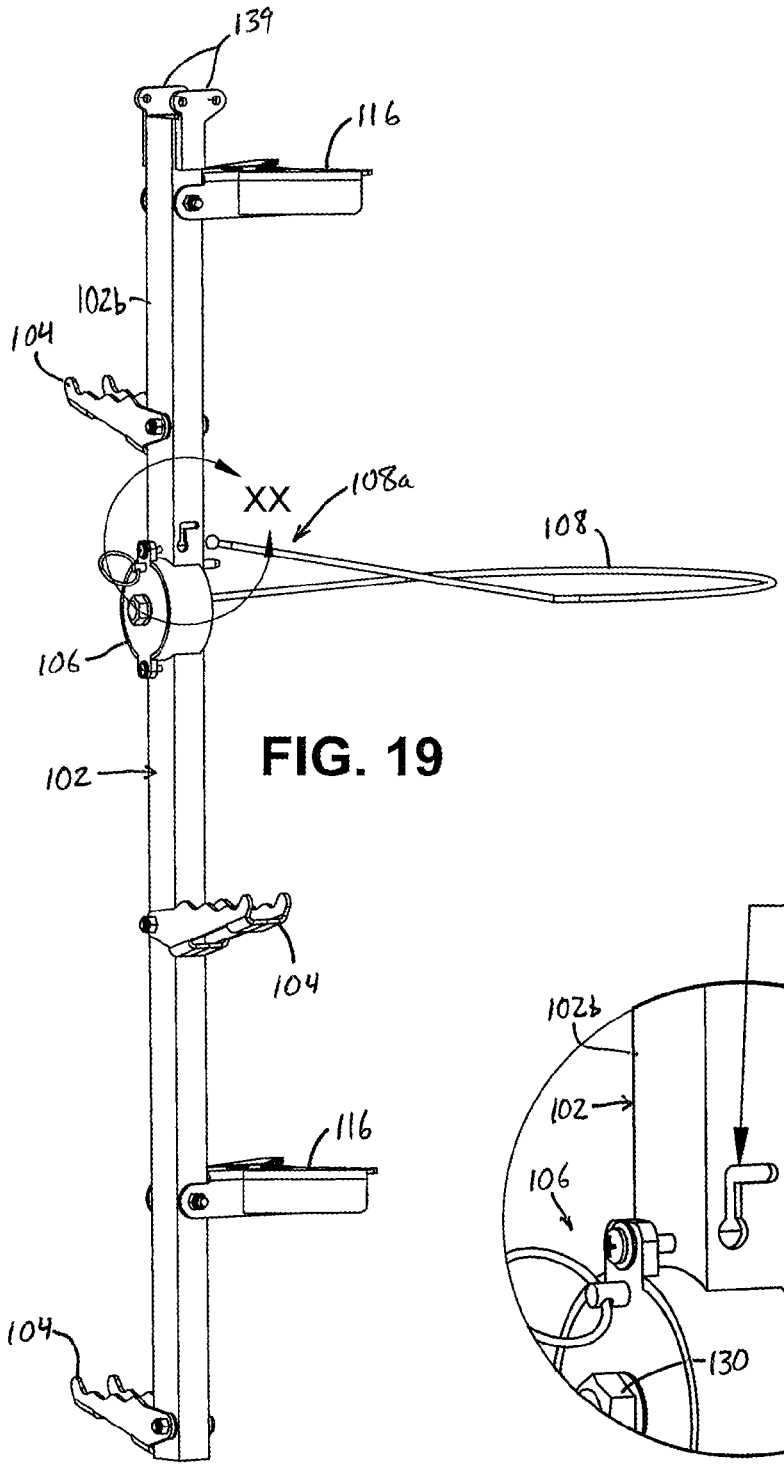
FIG. 19 is a rear perspective view of the lower subassembly portion of FIG. 11, showing a step of extending a cable for use in securing the assembly to a tree or pole.
Figure 20:
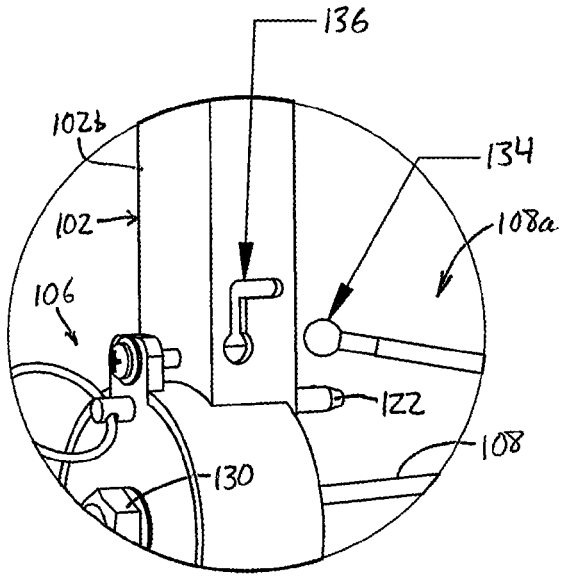
FIG. 20 is an enlarged view of the region designated XX in FIG. 19.

Flexible securing member 108 includes a distal end portion 108a having a ball-end 134for engaging an attachment element in the form of a keyhole slot 136 that is formed or established in elongate body 102, such as shown in FIGS. 19-21. Keyhole slot 136 is sized and shaped to selectively receive and retain the ball-end 134 at distal end portion 108a of securing member 108 when the securing member is extended from the elongate body and wrapped around the tree or pole in a procedure that will be understood with reference to FIGS. 19-21. It will be appreciated that flexible securing member 108 need not be tightened to a high-tension condition in order to secure climbing support assembly 100 to the tree 110, and that it will generally be sufficient to use wrench 132 to take up most of the slack in the flexible securing member 108. This is because most of the support assembly 100 will initially move downwardly after flexible securing members 108 are wrapped around tree 110 and secured in slot 136, especially during an initial application of weight to elongate body 102 and/or steps 104, but the middle portions of flexible securing members 108 that are in contact with tree 110 will tend to stay in place due to surface roughness of the tree 110. This applies tension to flexible securing members 108, which causes standoffs 116 to be drawn into biting engagement with the opposite side of tree 110, so that flexible securing members 108 and standoffs 116 cooperate to secure the support assembly 110 after the securing members 108 are extended and secured, and especially after additional load is applied. This also limits or prevents support assembly 110 from jamming in its engagement with tree 110 after use, since lifting elongate body 102 will once again create slack in flexible securing members 108 and allow ball ends 134 to be readily removed from keyhole slots 136, so that flexible securing members 108 can be readily disengaged from the tree 110 and wound into retractors 106 for storage or transport.

Figure 7:
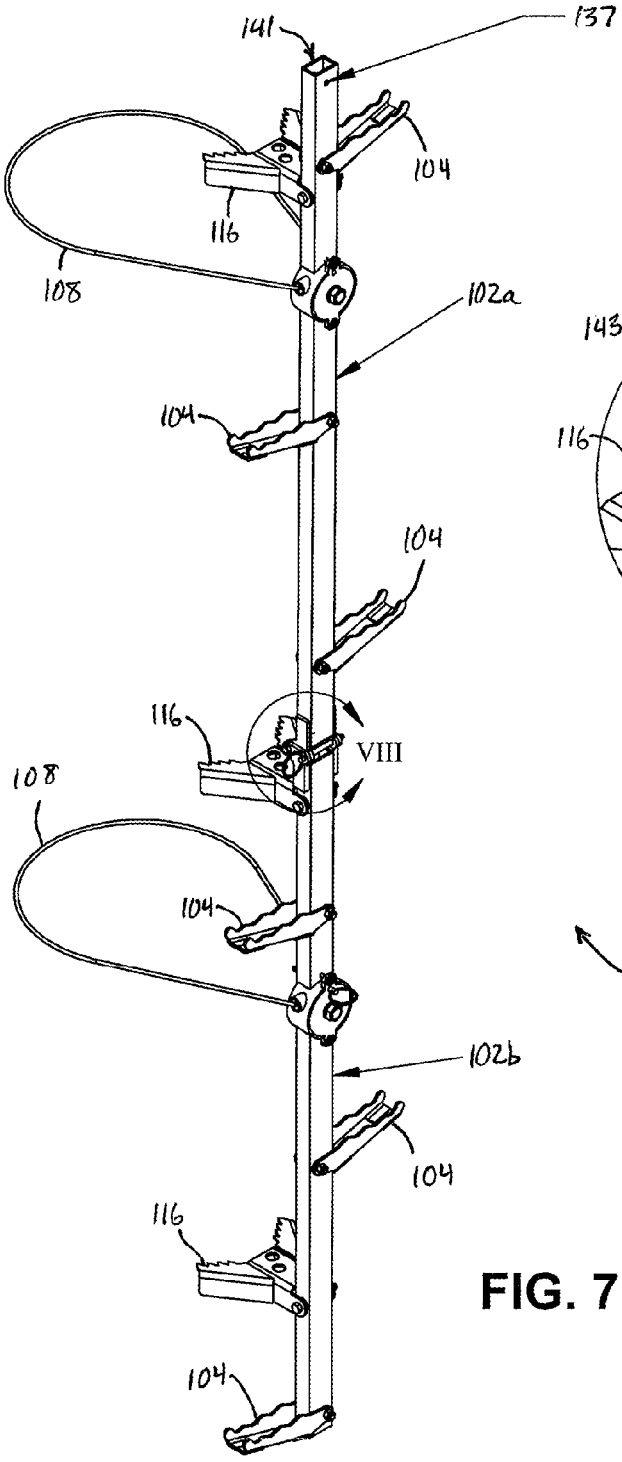
FIG. 7 is a perspective view of a lower subassembly of the climbing support of FIG. 1.

The upper climbing support subassembly 112 includes a lower engaging member in the form of a post 138 extending downwardly from a lower end of the elongate body 102 (FIGS. 4, 5, and 26-30), while the lower climbing support subassembly 114 includes an opening 141 in the upper end of the elongate body 102 (FIG. 7), which is configured to receive the post 138 so that the upper and lower climbing support subassemblies 112, 114 can be secured relative to one another. The subassemblies 112, 114 are securable via a lock pin 140 that is inserted through a bore 135 formed in post 138 and respective bores 137 formed in the elongate body 102 of lower climbing support subassembly 114 (near opening 141), such as shown in FIGS. 1-3.

In order to provide additional compactness for climbing support assembly 100 when in the stowage or transport configuration, the elongate body 102 of each climbing support subassembly 112, 114 includes an upper body portion 102*a* pivotably coupled to a lower body portion 102*b* via a hinge 142 (FIGS. 4-10), whereby the elongate body 102 is configurable between a compact configuration in which the upper body portion 102*a* is positioned alongside the lower body portion 102*b* in substantially parallel/adjacent arrangement (FIGS. 5, 6, 9, and 10), and an extended configuration in which the upper body portion 102*a* is positioned substantially in-line with the lower body portion 102*b* (FIGS. 1-4, 7, and 8).

Figure 6:
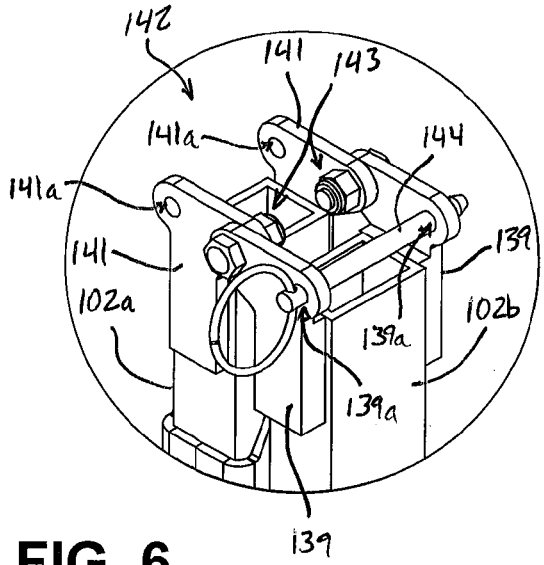
FIG. 6 is an enlarged view of the region designated VI in FIG. 5.
Figure 8:
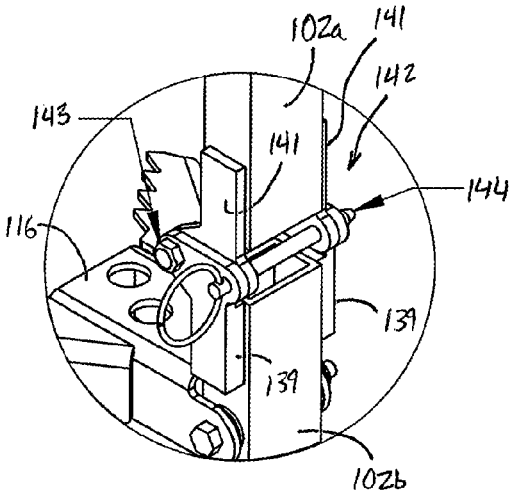
FIG. 8 is an enlarged view of the region designated VIII in FIG. 7.

Hinge 142 includes an upper bracket 139 at an upper end of lower body portion 102*b*, and a lower bracket 141 at a lower end of upper body portion 102*a*, such as shown in FIGS. 6, 8, and 10. Upper bracket 139 is pivotably coupled to lower bracket 141 via a pair of pivot bolts 143, while a lock pin or element 144 is positionable through respective bores 139*a*, 141*a* in upper bracket 139 and lower bracket 141, respectively (FIGS. 6 and 10), when upper body portion 102*a* and lower body portion 102*b* are aligned in the extended configuration (FIG. 8). Optionally, a releasable latch, strap, magnetic fastener, or the like may be provided at one or both of the upper and lower body portions 102*a*, 102*b* for retaining the body portions in the compact parallel/adjacent configuration.

Figure 11:
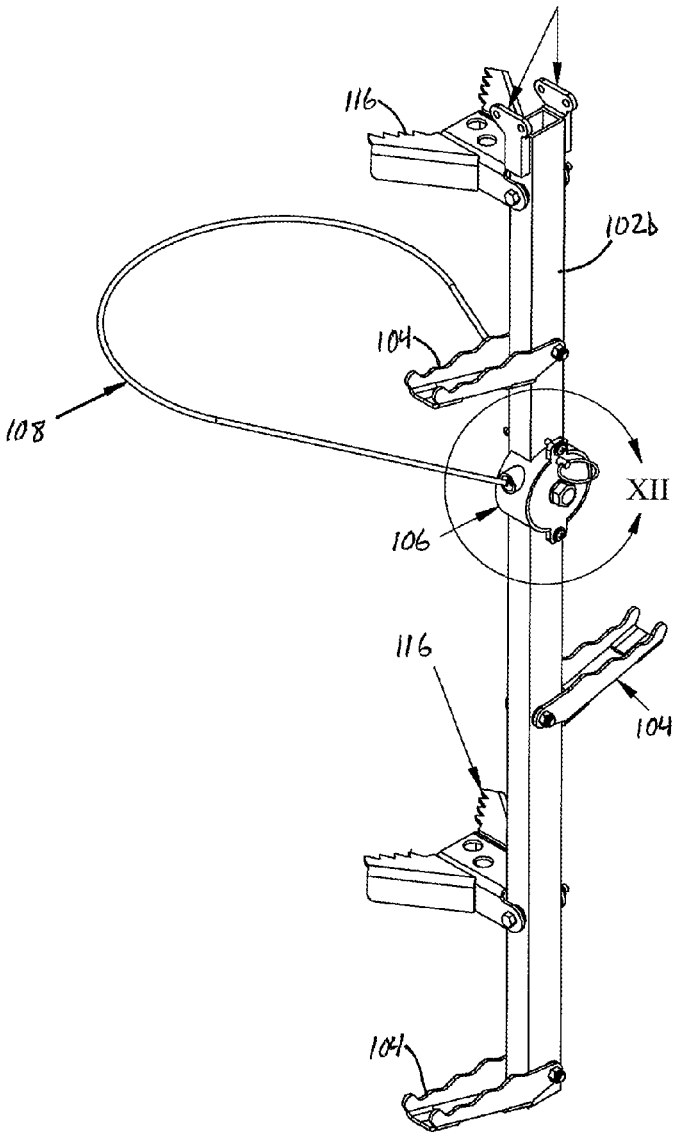
FIG. 11 is a perspective view of a lower portion of the lower subassembly of FIG. 7.
Figure 13:
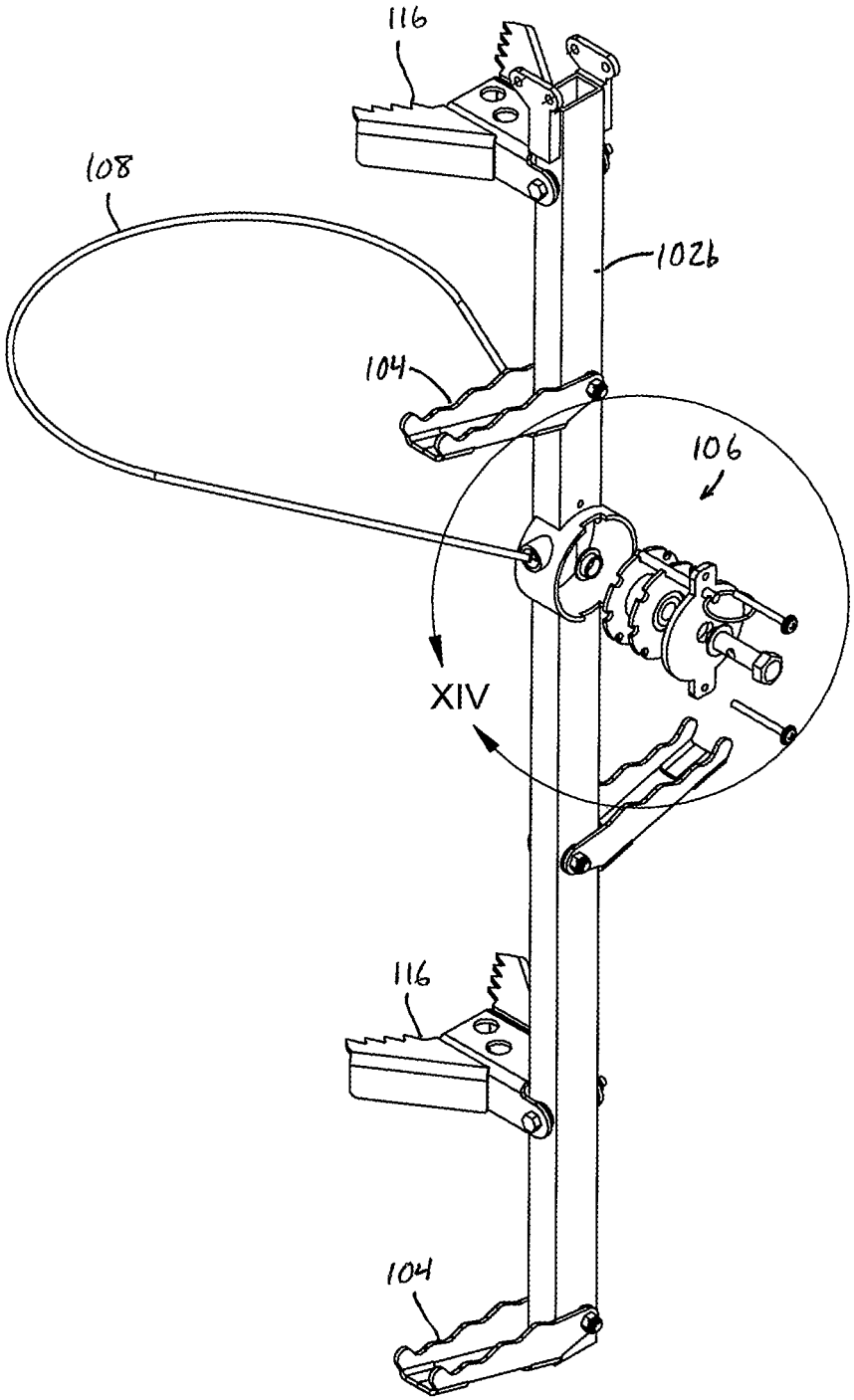
FIG. 13 is another perspective view of the lower subassembly portion of FIG. 11, with the cable retractor shown in an exploded view.

In the illustrated embodiment, lower climbing support subassembly 114 includes three standoffs 116, one of which is located at the upper end portion of the elongate body 102, and another of which is located at the lower end portion of the elongate body 102 (FIGS. 1-4 and 7). This allows lower climbing support subassembly 114 to be installed as a stand-alone unit along the tree 110, and it may be fully supported along the tree by two flexible securing members 108 and the three standoffs 116. However, in order to save weight and cost, in the illustrated embodiment upper climbing support subassembly 112 includes only two standoffs 116, which are located at the upper end portion and at a middle portion of its elongate body 102 (FIGS. 1, 2, and 11). The lower portion of the upper climbing support subassembly thus relies in part on the upper standoff 116 of the lower climbing support subassembly 114 to maintain the spacing of the upper climbing support subassembly's elongate body 102 at its lower end, such as shown in FIG. 1. Thus, if the upper climbing support subassembly 112 were to be coupled to the tree without being also secured to the lower climbing support subassembly 114, the lower portion of the upper climbing support subassembly's elongate body 102 may be expected to flex toward the tree 110 when supporting a user thereon, which may prevent the lower flexible securing member 108 from fully tensioning and supporting the weight. However, it is envisioned that the upper and lower climbing support subassemblies could both be configured for stand-alone use, and could be made substantially identical and interchangeable with one another, if desired, by providing sufficient standoffs for each subassembly, and by providing each subassembly with complementary posts and openings at the upper and lower ends of the elongate bodies so that two or more climbing support subassemblies may be coupled together to provide substantially any desired length (height) of climbing support assembly.

It is further envisioned that another climbing support assembly may include an alternative retractor that is at least partially integrated into the elongate body, and which does not require the use of tools for extending an retracting a flexible elongate securing member therefrom. For example, and with reference to FIGS. 36-43, an alternative climbing support assembly 200 is shown which includes an elongate body 202, fixed steps 204, an integral retractor system 206, a flexible securing member 208, and standoffs 216. Climbing support assembly 200 is similar to climbing support assembly 100, described above, except that steps 204 are fixed (although they could readily be made pivotable instead, like steps 104), elongate body 202 is a one-piece unit, and integral retractor system 206 is configured and operates differently from retractor 106, and utilizes a specially-shaped elongate body 202. Although retractor system 206 is primarily shown and described herein as being substantially internal to elongate body 202, it will be appreciated that different arrangements are possible, such as external or partially-external pulley arrangements. It will further be appreciated that climbing support assembly 200 may be equipped with pivoting steps and an elongate body made from two or more body portions that are pivotably attached to one another, similar to the climbing support assembly 100 described above.

Figures 41, 42, 43:
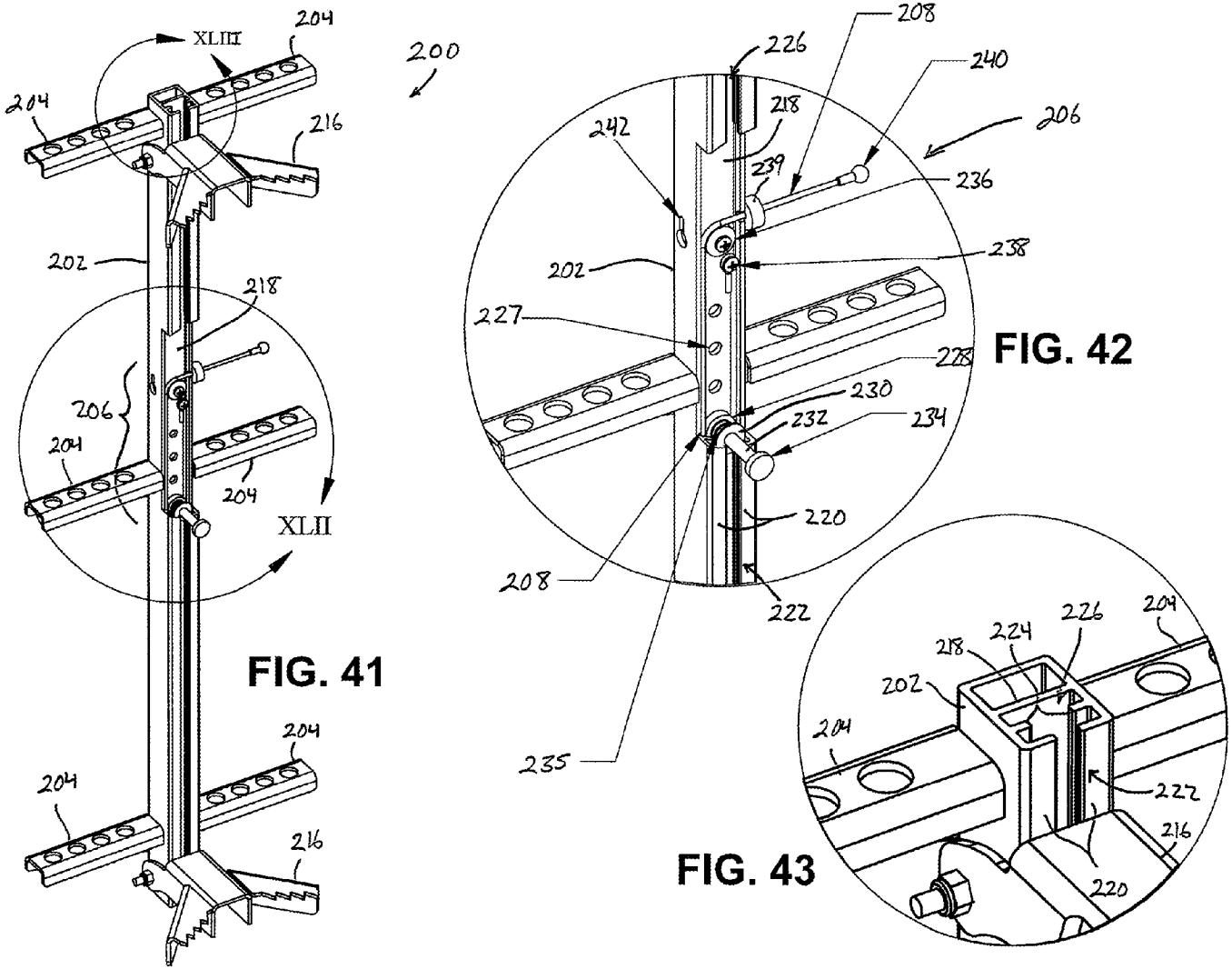
FIG. 41 is an enlarged rear perspective view of the climbing support of FIG. 36, with portions cut away to show internal structure and components.
FIG. 42 is an enlarged view of the region designated XLII in FIG. 41.
FIG. 43 is an enlarged view of the region designated XLIII in FIG. 41

As best shown in FIG. 41-43, the retractor system 206 is mostly internal to the hollow elongate body 202, and the elongate body 202 itself forms part of retractor system 206. Elongate body 202 is generally rectangular or square in shape, and includes an internal divider wall 218 (FIG. 43) along its length. A pair of front walls 220 forms the front surface of elongate body 202, and cooperate to define an external elongate slot 222 therebetween. Two intermediate ledges or walls 224 are spaced between front walls 220 and internal divider wall 218, and also define an internal elongate slot 226 therebetween. Internal divider wall 218 includes a plurality of bores 227 in longitudinally-spaced arrangement, and which are accessible through the elongate slots 222, 226. Front walls 220 may be at least partially notched or cut away to form an access opening 229 (FIGS. 37 and 39) that facilitates access to portions of integral retractor system 206, including stationary and movable pulleys, and a flexible securing member (e.g., a cable) and cable end anchor that are described below. Optionally, a cover may be removably fastened over access opening 229.

A rotatable and selectively translatable tensioning pulley 228 is mounted between internal divider wall 218 and intermediate ledges 224, and has a spaced flange 230 that is received between front walls 220 and intermediate ledges 224 (FIG. 42). Tensioning pulley 228 and flange 230 are both mounted to a pulley shaft 232, an outboard portion of which protrudes outwardly through external elongate slot 222 and terminates in a knob 234 intended for grasping by a user. An inboard portion of pulley shaft 232 extends through internal elongate slot 226, and an inboard tip portion or locking portion selectively extends inward past tensioning pulley 228 to engage one of bores 227. When the inboard tip portion of pulley shaft 232 engages one of the bores 227 formed in internal divider wall 218, tensioning pulley 228 is secured or locked against translating movement relative to elongate body 202. A spring 235 is positioned around pulley shaft 232 and located between tensioning pulley 228 and intermediate ledges 224, where it is held in compression and urges the inboard tip portion of pulley shaft 232 into engagement with one of the bores 227 when the shaft 232 is aligned with that bore 227.

A non-translatable stationary (but rotatable) pulley 236 is coupled to the elongate body 202 at internal divider wall 218, and is spaced above tensioning pulley 228. As will be described in more detail below, flexible securing member 208 is partially wrapped around stationary pulley 236 where the securing member exits elongate body 202, such as shown in FIG. 42. A fixed end of flexible securing member 208 is coupled to elongate body 202 at an anchor 238, which is fastened to internal divider wall 218 at a location slightly below stationary pulley 236 (although anchor 238 could be coupled elsewhere, such as above pulley 236).

With the fixed end of flexible securing member 208 attached to anchor 238, a middle portion of the securing member is routed downwardly and then wrapped ½ turn around tensioning pulley 228, after which the securing member 208 is routed upwardly until it reaches stationary pulley 236, where it completes a ¼ turn and exits out the side of elongate body 202 through a hole provided for that purpose (FIG. 42). Flexible securing member 208 is thus routed internally to elongate body 208 and, in the illustrated embodiment, is positioned in a generally rectangular chamber formed between internal divider wall 218 and intermediate ledges 224. A cable stopper 239 near the distal end of flexible securing member 208 prevents the distal end from retracting into elongate body 202, and a ball end 240 is configured to be received and removably secured in a keyhole slot 242 formed in the side of elongate body.

When tensioning pulley 228 is moved downwardly or away from stationary pulley 236, the increased distance between the pulleys 228, 236 draws additional length of flexible securing member 208 into elongate body 202. Because of the pulleys' multiplying effect, a given distance of movement of tensioning pulley 228 results in double that length of flexible securing member 208 being drawn into the elongate body 202, such as for drawing in slack when securing the climbing support assembly 200 to a tree. Conversely, moving tensioning pulley 228 upwardly or toward stationary pulley 236 allows the distal end of the flexible securing member 208 to be drawn out from the elongate body 202, such as for adding slack to the flexible securing member 208 when initially wrapping the securing member around the tree, or when loosening the securing member to remove the climbing support assembly 200 from the tree.

Tensioning pulley 228 is moved by grasping knob 234 of pulley shaft 232 and pulling outwardly to disengage the inboard tip portion of the pulley shaft 232 from one of the bores 227 formed in the internal divider wall 218, against the biasing force of spring 235. The user then slides the pulley shaft 232 toward or away from (e.g., upwardly or downwardly) stationary pulley 236 to either slacken the flexible securing member 208, or to take up slack in the securing member, respectively. Once the desired slack or tension is achieved, the user may release the knob 234 so that the inboard tip portion of the pulley shaft 232 engages the closest bore 227 in internal divider wall 218. The user may urge pulley shaft 232 slightly upward or downward as necessary to achieve proper alignment of the pulley shaft 232 with a bore 227. Accordingly, the exposed length or tension of flexible securing member 208 may be readily adjusted by a user with a single hand, including a gloved hand, so that the other hand can be used for stabilizing the user as needed.

The climbing support assemblies described above may be made primarily from steel or aluminum alloy or the like. For example, sheet steel or aluminum may be cut and formed (e.g., bent, welded, etc) to the desired shapes, and optionally painted, powder-coated, or epoxy-coated as a final finish, which could optionally be a camouflage pattern, for example. However, it will be appreciated that numerous other sufficiently strong and corrosion-resistant materials may be suitable, such as high-strength composite materials or the like.

Figure 45:
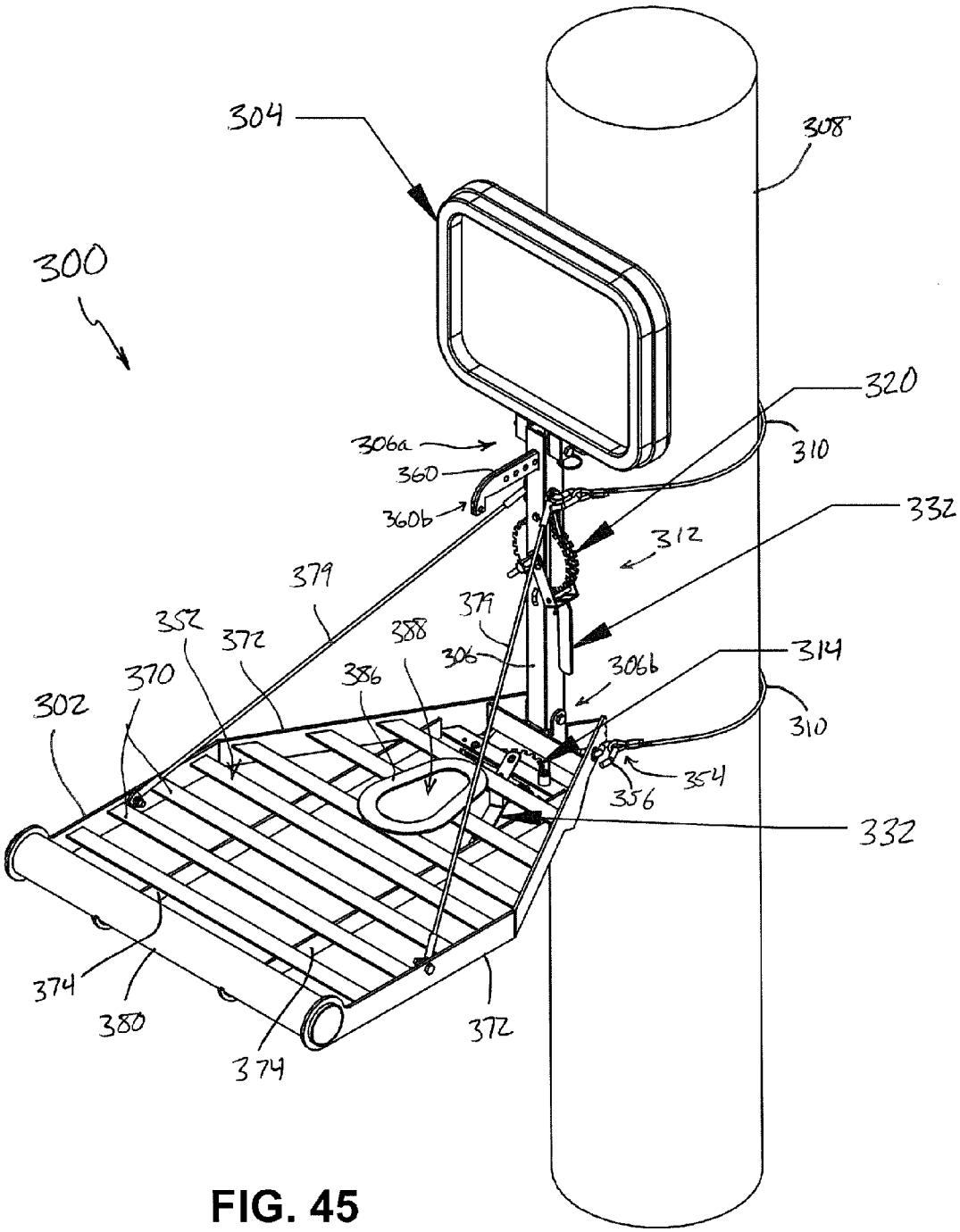
FIG. 45 is another left-side top perspective view of the tree stand of FIG. 44, in which the seat portion is pivoted up to a storage or transport position.
Figure 46:
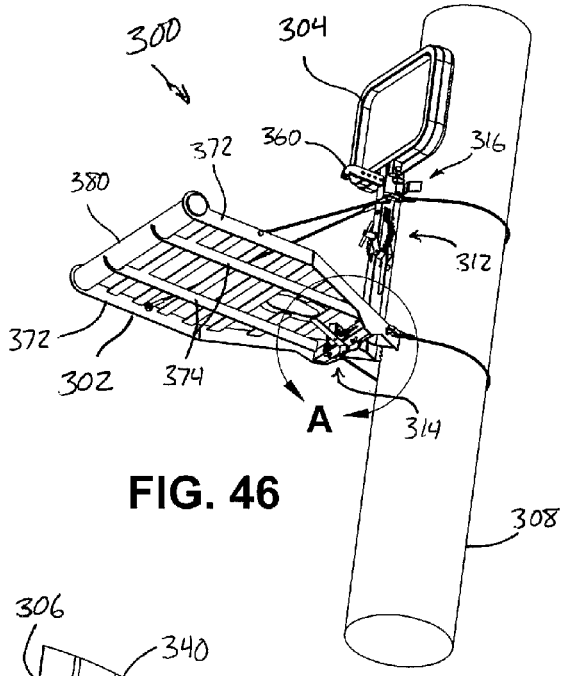
FIG. 46 is a left-side bottom perspective view of the tree stand of FIG. 45.
Figure 46A:
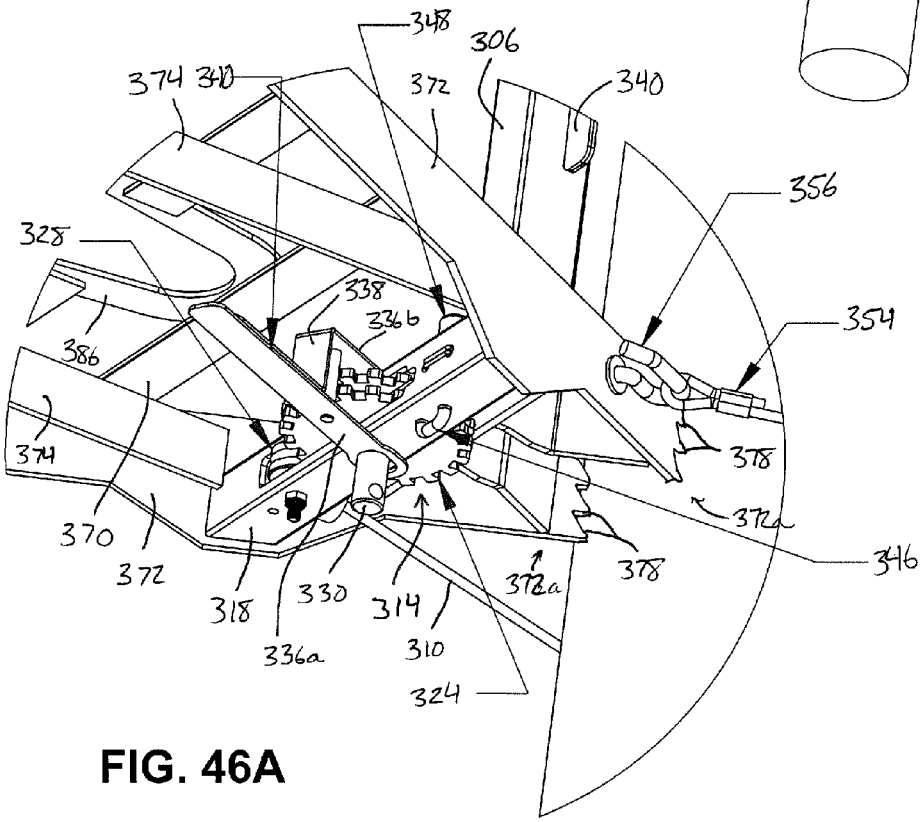
FIG. 46A is an enlarged view of the area designated 'A' in FIG. 46.

It will be appreciated that the principles of the tree climbing supports described above may be applied to other types of support devices such as tree stands and the like. For example, and with reference to FIGS. 44-60A, a tree stand 300 includes a footrest or step or standing platform 302, and a seating platform or step 304, each of which is pivotally coupled to a respective end of an elongate body 306, such as shown in FIGS. 44-46, 47, 48, 53-55, 56-59, and 60. Tree stand 300 is securable to a tree or pole 308 using a pair of elongate securing members such as cables 310 that are mounted, respectively, to an upper retractor 312 and a lower retractor 314. In the illustrated embodiment, seating platform 304 is coupled to an upper end portion 306*a* of elongate body 306, with an adjustable standoff member 316 positioned at upper end portion 306*a* below seating platform 304, and with upper retractor 312 position below standoff member 316. The footrest or standing platform 302 is coupled to a lower end portion 306*b* of elongate body 306, and lower retractor 314 is coupled to a structural cross-member 318 along an underside of footrest platform 302, such as shown in FIGS. 46 and 46A.

Figure 47A:
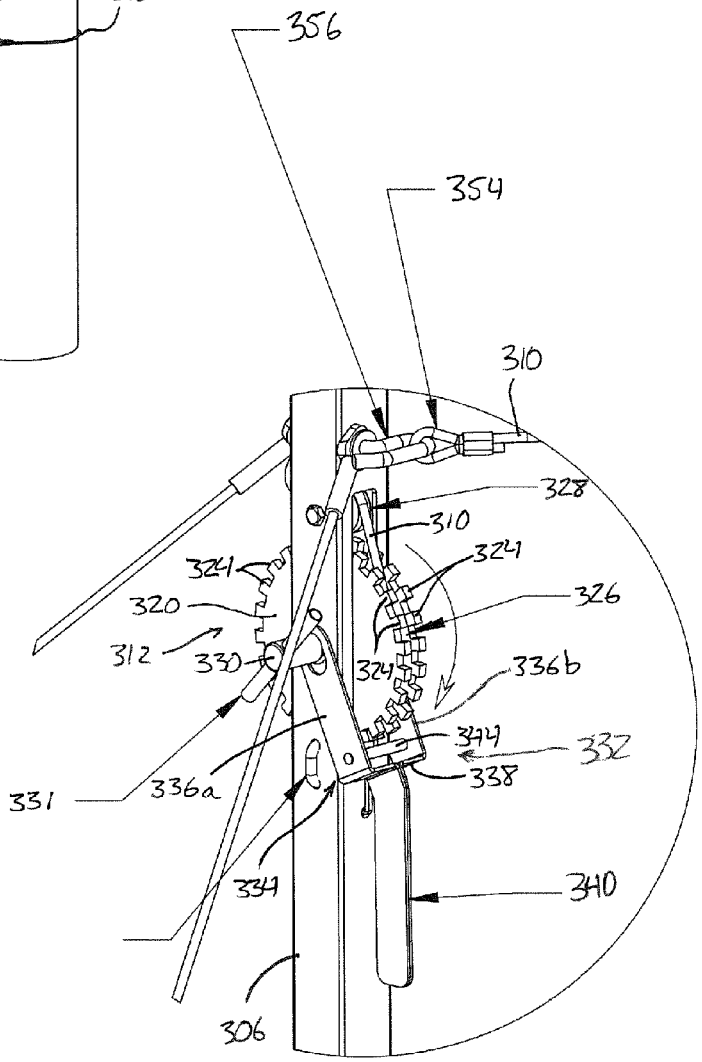
FIG. 47A is an enlarged view of the area designated 'A' in FIG. 47.
Figure 48:
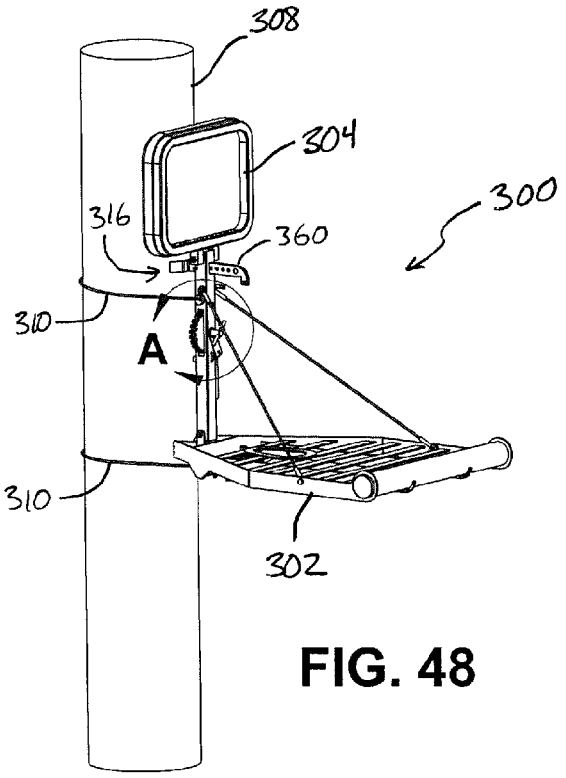
FIG. 48 is a right-side top perspective view of the tree stand of FIG. 45.
Figure 48A:
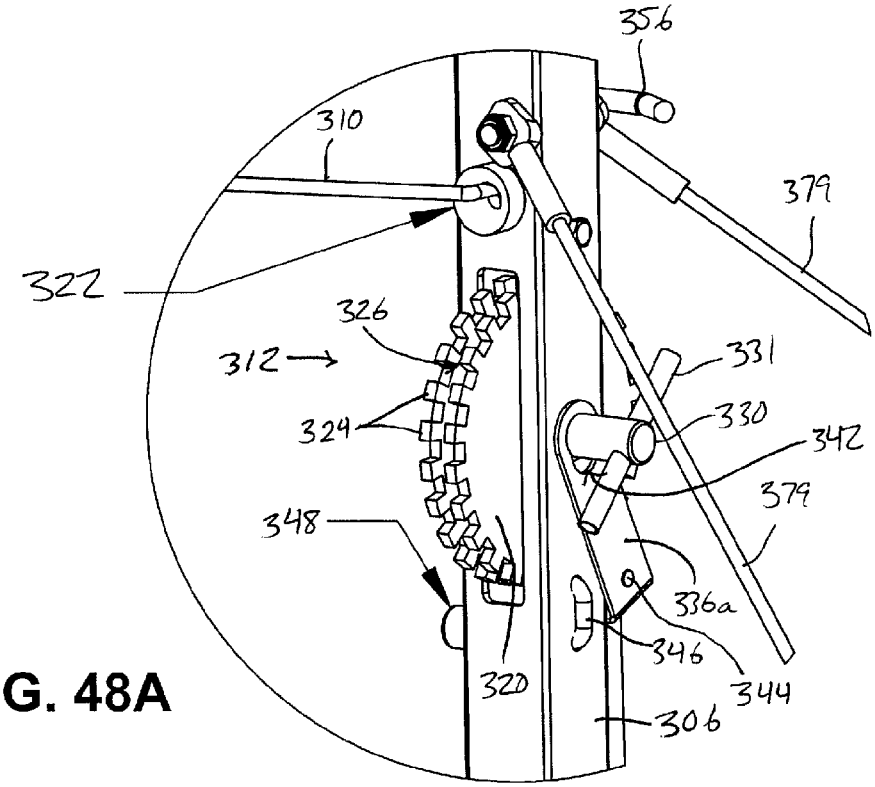
FIG. 48A is an enlarged view of the area designated 'A' in FIG. 48.

Upper retractor 312 is similar in some respects to retractors 106, described above, including a spool 320 that is mounted partially inside an interior region of elongate body 306, with elongate securing member or cable 310 wrapped around the spool 320 and passing through the interior region of elongate body 306 before exiting the elongate body through an opening 322 that is located above spool 320 and is fitted with an optional guide bezel or grommet (FIG. 48A). Opposite sides of spool 320 are exposed on either side of elongate body 306, with a plurality of radially-extending ridges or teeth 324 along a generally circular outer perimeter of spool 320. In the illustrated embodiment, the spaced-apart front and rear disc-like surfaces of spool 320 have respective sets of ridges or teeth 324 that are in alignment with one another, with a circular wrapping-surface or channel 326 disposed in the space between the disc-like surfaces, around which elongate securing member 310 is wrapped (FIG. 47A). A cable roller or pulley 328 is mounted in the interior region of elongate body 306, above spool 320, and guides the cable 310 through the interior region of the elongate body 306 and out through opening 322.

Figure 51:
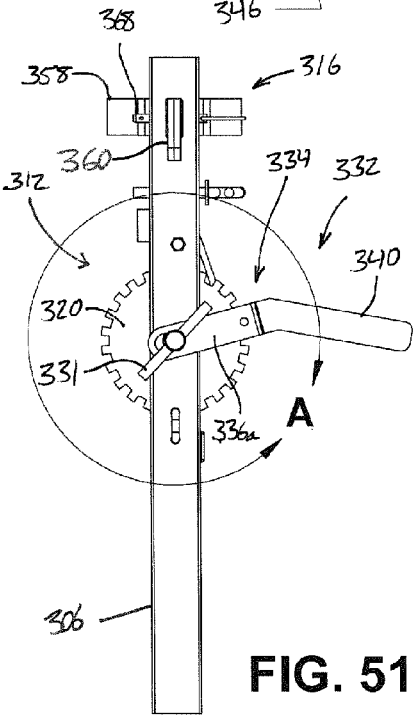
FIG. 51 is a front elevation of the structural body and attachment mechanism of FIG. 50.
Figure 51A:
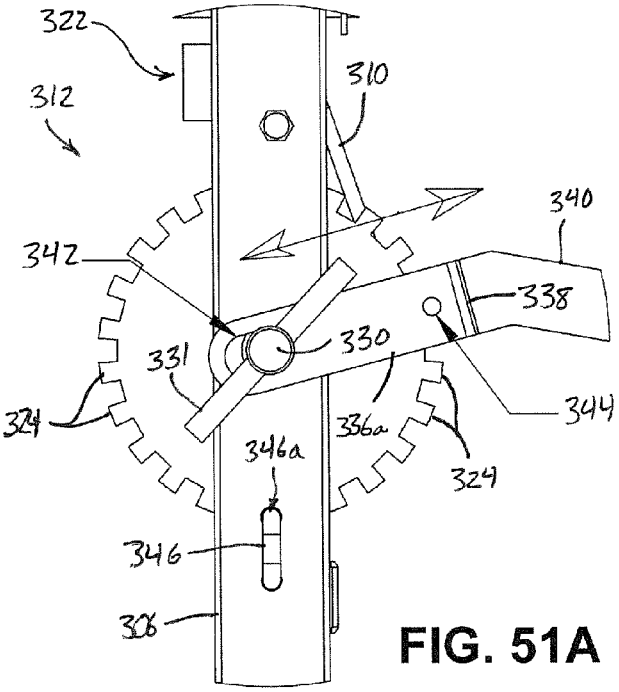
FIG. 51A is an enlarged view of the area designated 'A' in FIG. 51.

Spool 320 is rotatably mounted on a spindle 330 that extends transversely through the elongate body 306, with a forwardly-extending end having a T-handle 331 that facilitates rapid hand-turning of spindle 330 and spool 320, such as for quickly taking up slack in cable 310. In addition, a crank 332 is mounted to spindle 330, outboard of elongate body 306, and has a generally U-shaped yoke 334 having a forward leg 336*a*, a rearward leg 336*b*, and a bite 338, with a gripping handle 340 extending outwardly from a central region of bite 338. The forward leg 336*a* and rearward leg 336*b* each have a slotted opening 342 (FIGS. 48A and 51A) that receives a respective projecting end of spindle 330, such as shown in FIGS. 47A, 48A, 52, and 59A, which permits crank 332 to move radially inwardly and outwardly a limited distance relative to spindle 330 and spool 320.

Crank 332 includes a tooth-engaging crossbar 344 that spans between forward leg 336*a* and rearward leg 336*b*, and is spaced inwardly from bite 338 to selectively engage the spool teeth 324 when crank 332 is manually pushed inwardly. This allows a user to grasp handle 340 in one hand when the handle 340 is in the lowered storage position (FIGS. 47A, 48A, and 49), raise the handle to an elevated position (FIGS. 50-51A) while keeping bite 338 disengaged from teeth 324, and then moving crank 332 radially inwardly toward spool 320 and spindle 330 to engage bite 338 with the nearest teeth 324, and then pulling down on gripping handle 340 to rotate spool 320 and wind cable 310 onto the wrapping surface 326 of spool 320 in order to tighten cable 310 around the tree 308. This can be quickly accomplished in a repetitive motion if desired, such as in the manner generally indicated by a curved arrow in FIG. 47A and a double-ended arrow in FIG. 51A, although it is envisioned that a user will use T-handle 331 to take most of the slack out of cable 310, so that only a partial turn of spool 320 (and a single up-down movement of crank 332) will be sufficient to provide adequate tension in the cable 310.

A lock member 346 extends through elongate body 306 below spool 320, and is spring-biased inwardly (FIGS. 47A, 48A and 49) so that an upper end portion 346*a* (FIGS. 50 and 52) engages teeth 324 of spool 320 and thereby locks the spool against rotation in either direction. Lock member 346 includes a pushbutton 348 at its rear end, below and behind upper end portion 346*a*. Pushbutton 348 projects through a circular opening along the rear surface of elongate body 306, and permits the user to push lock member 346 forwardly against the biasing force of a coil spring 350 (FIGS. 52 and 59A) in the interior region of elongate body 306. This movement disengages the lock member's upper end 346*a* from teeth 324 inside elongate body 306, so that spool 320 will be free to turn in response to tension on cable 310 or in response to torque applied at T-handle 331 or crank 332. Pushbutton 348 is located so that a user can grasp elongate body 306 in the left hand, just below spool 320, while depressing the pushbutton 348 and simultaneously manipulating T-handle 331 or crank 332 to tighten cable 310 to a desired tension level. It is further envisioned that, in an alternative arrangement, a conventional ratcheting mechanism may be incorporated into or along the elongate body 306, to thereby obviate the need to manually hold a pushbutton or lever at all times during which spool 320 is being rotated.

Lower retractor 314 operates in substantially the same manner as upper retractor 312, and is usable when footrest platform 302 is in the deployed or horizontal position, as best shown in FIGS. 46 and 46A. Lower retractor 314 is disposed in cross-member 318 of footrest platform 302, and may be substantially identical to upper retractor 312 mounted in elongate body 306. Lower retractor 314 includes a spool 320 having a plurality of teeth 324, and receiving cable 310 between the two sets of teeth. A spindle 330 is oriented substantially vertically when footrest platform 302 is deployed, and a crank 332 and T-handle (not shown) are provided for rotating spool 320. Unlike upper retractor 312, however, the crank 332 of lower retractor 314 has its gripping handle 340 positioned along a lower end of bite 338, contiguous with a lower leg 336*a* of the U-shaped yoke 334, to provide extra clearance for a user's fingers below a platform surface 352 of footrest platform 302. Lower retractor 314 further includes a tooth-engaging crossbar 344 at the yoke 334, along with a lock member 346, so that lower retractor 314 operates substantially identically to upper retractor 312, described above.

By mounting lower retractor 314 to footrest platform 302, lower retractor 314 is prevented from interfering with upper retractor 312, and without need for a longer elongate body than is otherwise required. However, it is envisioned that a lower retractor could be provided at the lower end portion of the elongate body in substantially the same manner as upper retractor 314, without departing from the spirit and scope of the present invention. In such an arrangement, a different style of retractor may be appropriate to facilitate operation of both retractors in closer proximity to one another, although a longer elongate body may be used to provide increased separation of the retractors.

Each cable 310 has a loop 354 formed or established at its distal end, which loop is placed around a respective attachment element in the form of a hook 356, one of which is located along the left side of footrest platform 302 (FIG. 46A), and the other of which is located above upper retractor 312, opposite opening 322 (FIGS. 47A and 48A). However, it will be appreciated that other devices may be used for securing cables 310, such as a ball-end or T-pin-end on each cable that is received in a keyhole slot formed in elongate body 306.

Figure 52:
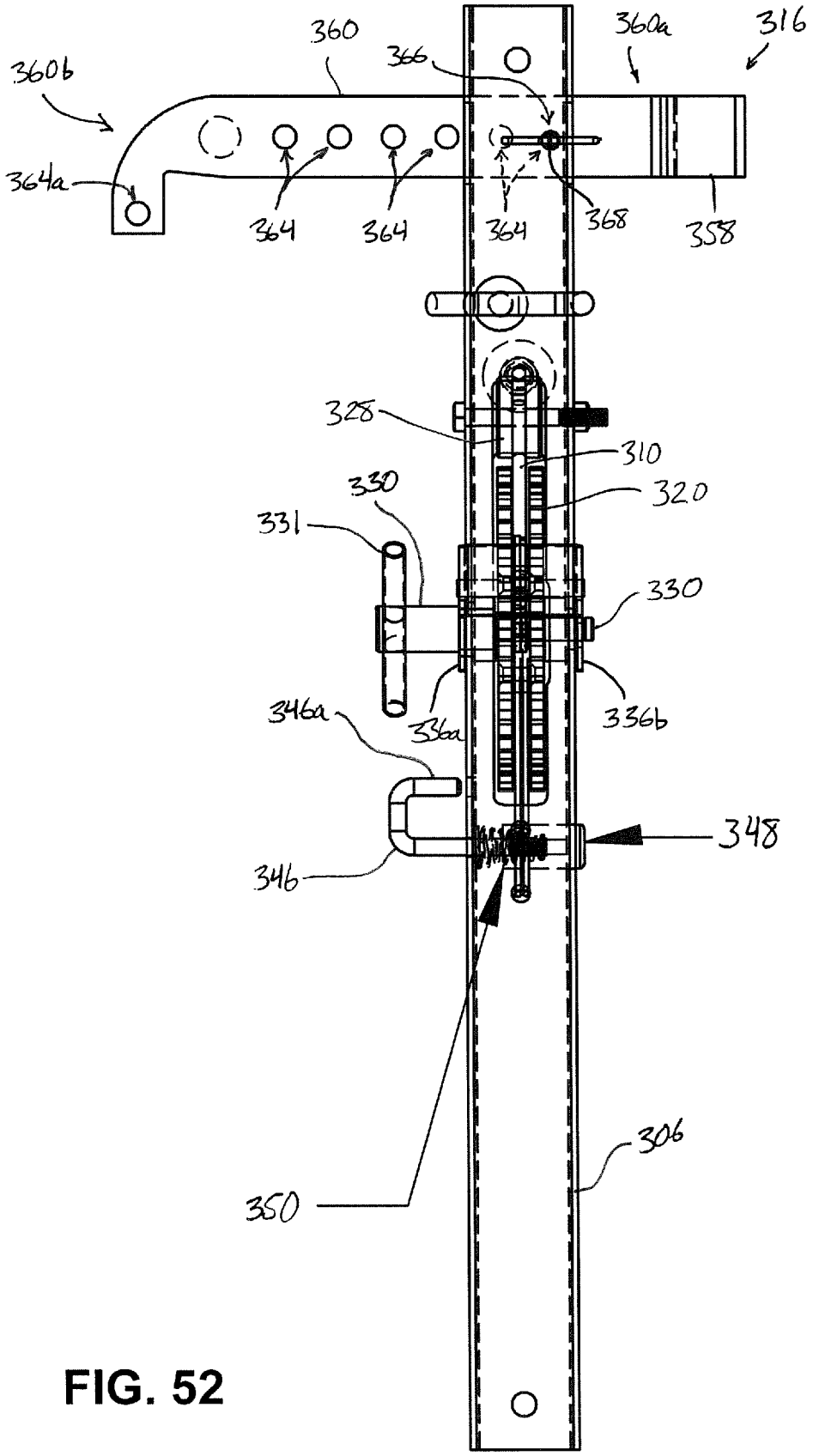
FIG. 52 is a left side elevation of the structural body and attachment mechanism of FIG.

Adjustable standoff member 316 includes a tree-engaging portion 358 and an elongate shaft 360 that extends forwardly from the tree-engaging portion 358, such as shown in FIGS. 49, 50, 52, 53, 55A, 58, and 59A. Tree-engaging portion 358 is at a rearward end 360*a* of elongate shaft 360, which passes forwardly through openings 362 formed in front and rear surfaces of elongate body 306. Shaft 360 terminates at a forward end portion 360*b* that narrows and turns approximately 90 degrees relative to a main or central portion of the shaft (FIG. 52). The main portion of elongate shaft 360 has a plurality of cross-bores 364 formed therein, which bores are spaced apart from one another and located between the rear and forward ends 360*a* , 360*b* of the elongate shaft. Bores 364 selectively align with a pair of openings 366 formed on opposite sides of elongate body 306 as standoff member 316 is moved forwardly or rearwardly to slide elongate shaft 360 through openings 362, so that a lock pin 368 may be slid through the openings 362 and one of the bores 360 that is aligned there with, such as shown in FIGS. 49, 50, 52, and 55A. Thus, the fore/aft position of elongate shaft 360 can be adjusted (as indicated by a double-ended arrow in FIG. 55A) and set using lock pin 368 (which includes a grasping ring 369 at one end), such as to set the angle of elongate body 306 relative to tree 308, which may be particularly useful when tree stand 300 is mounted in a tree that is leaning, such as shown in FIG. 56. Optionally, it is envisioned that a manually releasable ratcheting mechanism could be used for adjusting and setting the position of the standoff member relative to the elongate body, without using a lock pin that is removed and re-inserted.

Standoff member 316 can be readily moved to a storage configuration in which its elongate shaft 360 and tree-engaging portion 358 lie against or proximate a rear surface of elongate body 306, such as shown in FIGS. 58 and 59A. Forward end 360*b* of the elongate shaft 360 is sufficiently narrow so that as it enters the forward opening 362 of elongate body 306, standoff member 316 is permitted to drop to the storage position while the forward end 360*b* remains in the interior region of elongate body 306. Forward end 360*b* includes a cross-bore 364*a* near its tip, which bore 364a can be readily aligned with openings 366, once standoff member 316 is substantially in its storage position. Lock pin 368 can then be inserted through the openings 366 of elongate body 306, and simultaneously through the bore 364a to thereby secure standoff member 316 to the elongate body 306. Optionally, a retention device such as a strap, magnet, hook-and-loop fastener, snap-button, or the like may be used to secure standoff member 316 in the storage position of FIGS. 58-59A, to limit or prevent it from pivoting upwardly until the user is ready to set up the tree stand 300.

Figure 44:
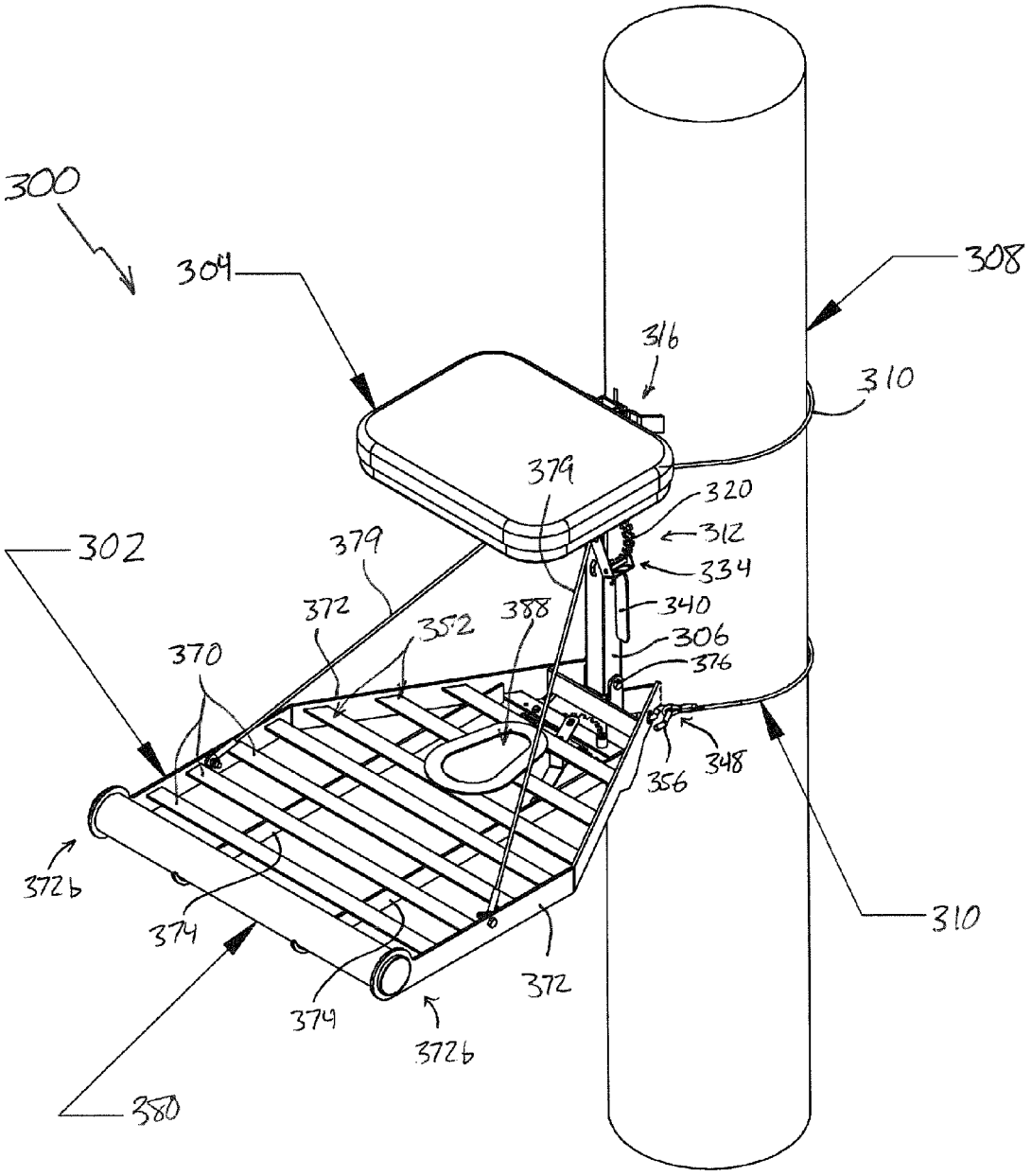
FIG. 44 is a left-side top perspective view of a tree stand in accordance with the present invention, shown supported at a tree or pole.

Footrest platform 302 provides a sturdy surface that is sufficiently large for a user to rest his or her feet while seated at seating platform 304, and which may be used as a surface for standing, provided that the user is tethered to the tree 308 at all times. Platform surface 352 is made up of a plurality of slats 370 that span between a pair of formed side rails 372, and are further supported on a pair of intermediate support rails 374 that are located inboard of side rails 372, such as shown in FIGS. 44-46A. Platform 302 is pivotally coupled at its proximal end to lower end portion 306*b* of elongate body 306, such as with a hinge shaft or bolt 376, as shown in FIGS. 44, 45, 53, and 59. Side rails 372 have respective proximal ends 372*a* that terminate in serrations or teeth 378 (FIG. 46A), which engage an outer surface of the tree 308 in order to limit or prevent slippage of tree stand 300 relative to the tree upon tightening of the cables 310, and in particular upon tightening the lower cable 310 mounted on lower retractor 314. A pair of flexible support cables 379 have upper or proximal ends secured to upper end portion 306*a* of elongate body 306 (FIGS. 45 and 47-48A), with lower or distal ends of secured to a respective side rails 372 (FIGS. 44 and 45). Support cables 379 can remain attached to the elongate body 306 and side rails 372 when footrest platform 302 is in either the deployed configuration or the storage configuration. Optionally, it is envisioned that support cable 379 may include a provision, such as a turnbuckle, for adjusting the length of the support cable to set the angle of footrest platform 302 relative to elongate body 306 when the footrest platform is in the deployed configuration.

Distal ends 372*b* of side rails 372 have an enlarged circular openings in which a storage tube 380 is mounted. Storage tube 380 may be further supported at its midsection by respective distal ends of the intermediate support rails 374, such as shown in FIGS. 44-46. Referring to FIG. 60A, storage tube 380 has an opening 382 formed at its end, which opening can be selectively plugged or capped with a cover 384 that, optionally, may be tethered to footrest platform 302 using a flexible cord or chain. Storage tube 380 may be used to store various articles, such as a rain bonnet or umbrella that can be secured to the tree 308 above tree stand 308 for shielding the user from rain. Storage tube 380 may also be used to store rolled maps or other papers, snack foods, animal calls, etc. In the illustrated embodiment, storage tube 380 forms the distal end of platform surface 352, which is raised above the level of slats 370 and therefore provides an easily-detectable end to the platform surface. This enables a user to feel the end of the platform with the feet, even when wearing heavy boots, without need for looking down at the platform.

In addition, a bezel 386 is attached to certain ones of the slats 370 and is spaced distally from lower retractor 314, and forms an opening 388 through which T-handle 331 and lock member 346 of upper retractor 312 are made accessible through footrest platform 302 in the raised storage position, such as shown in FIGS. 54 and 54A. This permits the user to place the tree stand 300 in its storage or transport configuration against a tree 308, wrap the upper cable 310 around the tree (optionally with standoff member 316 already set in a use position, such as shown in FIG. 53), and rotate spindle 330 to take up enough slack in the cable so that the tree stand will support at least its own weight along the tree (FIGS. 53 and 54) until the user can move the tree stand to its final desired position, deploy the footrest platform 302, secure the lower cable 310, and fully tighten both cables 310 with their respective retractors 312, 314 to secure the tree stand 300 for use.

Thus, tree stand 300 can assume a relatively flat and easily transportable storage configuration, such as shown in FIGS. 57-59, be placed against the tree 308 in which it will be mounted, and initially secured using the upper cable 310 while the tree stand is still substantially in its storage configuration. Because tree stand 300 can be set into its final desired location while remaining in the compact storage configuration, raising and lowering the tree stand is made easier than if it were in the deployed configuration. The deployed configuration is easily achieved by lowering footrest platform 302 and seating platform 304, and tightening the retractors 312, 314 with the respective cables 310 wrapped around the tree 308 and secured to the hooks 356 provided along elongate body 306. Tree stand 300 can be taken down in substantially the reverse order of steps, with the upper cable 310 left in place, albeit somewhat loosened to have some slack, to prevent the tree stand from free-falling and to facilitate lowering it in a controlled manner.

Accordingly, the tree climbing apparatuses and supports of present invention can generally be installed by a single user along a tree, pole, or the like, to facilitate reaching a substantial distance up above the ground. The climbing support assemblies and tree stand assemblies can be configured in a compact stowage or transport configuration so that several assemblies may be carried at once by a single user, and include retractors for convenient and non-tangled stowage of securing cables, straps, or the like when the assemblies are not in use. Once the climbing support assembly is fully secured, the steps or supports may be used as hand-holds and/or foot-holds, seats or footrests, as a climber scales or supports himself or herself in a tree or other surface to which the climbing apparatus is attached. A standoff increases the space between the steps (or seat or platform, etc.) and the tree, and cooperates with the flexible securing member to support and stabilize the climbing support assembly along a tree or pole. The standoff and the steps may be repositionable between use configurations and more compact storage or transport configurations, and the elongate body or main frame member of the assembly may be collapsible to reduce its overall length and/or width and/or thickness for storage or transport.

Changes and modifications in the specifically-described embodiments can be carried out without departing from the principles of the present invention which is intended to be limited only by the scope of the appended claims, as interpreted according to the principles of patent law including the doctrine of equivalents.

The invention claimed is:

1. A support for supporting a user along a tree or pole, said support comprising:

an elongate body defining an interior region;

a foot support extending outwardly from said elongate body;

a flexible elongate securing member coupled to said elongate body at said interior region thereof, wherein at least a portion of said securing member is selectively extendable outwardly from said interior region of said elongate body and is configured to wrap around a tree or pole to thereby attach said support thereto, and wherein at least a portion of said securing member is retractable at said elongate body for compact storage or transport when said securing member is not in use; and a retractor disposed at said elongate body, said retractor operable to selectively retract at least a portion of said securing member for storage inside said interior region of said elongate body, and operable to permit said securing member to be extended outwardly from said interior region of said elongate body for use in securing said support to the tree or pole.

2. The support of claim 1, wherein said retractor comprises a spool for selectively winding and unwinding said securing member between retracted and extended configurations, wherein said spool comprises a spindle disposed in said interior region of said elongate body.

3. The support of claim 2, wherein said retractor comprises a lock member for selectively securing said spool against rotation.

4. The support of claim 3, wherein said retractor comprises a handle coupled to said spindle and said spool comprises a plurality of teeth arranged around a perimeter thereof, and wherein said handle is configured to selectively engage said teeth to thereby rotate said spool and tighten said securing member.

5. The support of claim 1, wherein said retractor comprises a tensioning pulley about which said securing member is wound, said tensioning pulley being translatable relative to said elongate body to thereby adjust tension or slack in said securing member.

6. The support of claim 5, wherein said retractor further comprises a substantially non-translatable pulley coupled to said elongate body and spaced from said tensioning pulley, and wherein said securing member is wound at least partially around said non-translatable pulley.

7. The support of claim 6, wherein said securing member comprises:

a first end portion fixedly secured to said elongate body;

a second end portion that is extendable and retractable relative to said elongate body; and a middle portion between said first and second end portions;

wherein said middle portion of said securing member extends from said first end portion, wraps around said tensioning pulley, wraps around said non-translatable pulley, and extends outwardly from said elongate body where said securing member is terminated at said second end portion.

8. The support of claim 5, wherein said elongate body comprises a generally tubular structure having an internal elongate divider wall to which said first end portion of said securing member and said non-translatable pulley are coupled.

9. The support of claim 8, wherein said generally tubular structure of said elongate body further comprises at least one outer wall spaced outwardly from said divider wall and defines an elongate channel for translatably supporting said tensioning pulley.

10. The support of claim 9, wherein said tensioning pulley comprises:

a shaft having a grasping end portion that projects outwardly from said elongate body;

a lock end portion opposite said grasping end portion;

wherein said shaft is axially movable between an unlocking position and a locking position; and wherein said divider wall of said elongate body comprises a plurality of bores in longitudinally-spaced arrangement for selectively receiving said lock end portion of said tensioning pulley in said locking position to thereby selectively secure said tensioning pulley against translation relative to said elongate body.

11. The support of claim 1, wherein said foot support is pivotably coupled to said elongate body, and is pivotable between an outwardly-extending position for use as a handhold or foot support, and a retracted position for compact stowage along said elongate body.

12. The support of claim 11, further comprising another retractor and another a flexible elongate securing member mounted at said foot support, for further securing said support to the tree or pole.

13. The support of claim 12, wherein said other retractor is operable to selectively retract at least a portion of said other securing member for storage inside an interior region of said foot support, and wherein said other retractor is operable to permit said securing member to be extended outwardly from said foot support for use in securing said support to the tree or pole.

14. The support of claim 11, further comprising a pivotable seating platform coupled to said elongate body above said foot support.

15. The climbing support of claim 1, further comprising a standoff member coupled to said elongate body and configured to engage the tree or pole and to maintain a space between said elongate body and the tree or pole when said securing member is wrapped around the tree or pole, wherein said standoff member is repositionable between a substantially horizontal orientation for engaging the tree or pole, and a substantially vertical orientation along said elongate body for compact stowage and transport.

16. The climbing support of claim 1, wherein said standoff member is adjustably securable to said elongate body in at least two different positions, wherein a space between said elongate body and the tree or pole is adjustable according to the position of said standoff member relative to said elongate body.

17. A support for supporting a user along a tree or pole, said support comprising:

an elongate body having upper and lower end portions and defining an interior region;

a deployable support pivotably coupled to each of said upper and lower end portions of said elongate body, wherein said deployable supports are each positionable between an extended use position and a retracted transport position;

a repositionable standoff member pivotably coupled to said elongate body and configured to engage the tree or pole and to maintain a space between said elongate body and the tree or pole, wherein said standoff member is repositionable between a substantially horizontal orientation for engaging the tree or pole, and a substantially vertical orientation along said elongate body for compact stowage and transport; and a flexible elongate securing member coupled to said elongate body and configured to wrap around the tree or pole to thereby attach said support thereto, wherein at least a portion of said flexible elongate securing member is stowed and secured in said interior region of said elongate body.

18. The support of claim 17, further comprising a retractor coupled to said elongate body, wherein said flexible elongate securing member is secured to said retractor, wherein said deployable support defines an opening, and wherein when said deployable support is in the retracted transport position, said retractor is accessible through said opening in said deployable support and is operable to retract said flexible elongate securing member.

* * * * *